US008311245B2

(12) United States Patent
Liu

(10) Patent No.: US 8,311,245 B2
(45) Date of Patent: Nov. 13, 2012

(54) THERMOACOUSTIC MODULE, THERMOACOUSTIC DEVICE, AND METHOD FOR MAKING THE SAME

(75) Inventor: Liang Liu, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 463 days.

(21) Appl. No.: 12/762,488

(22) Filed: Apr. 19, 2010

(65) Prior Publication Data

US 2010/0260359 A1 Oct. 14, 2010

Related U.S. Application Data

(63) Continuation of application No. 12/655,415, filed on Dec. 30, 2009.

(30) Foreign Application Priority Data

| | | |
|---|---|---|
| Dec. 30, 2008 | (CN) | 2008 1 0191731 |
| Dec. 30, 2008 | (CN) | 2008 1 0191732 |
| Dec. 30, 2008 | (CN) | 2008 1 0191739 |
| Dec. 30, 2008 | (CN) | 2008 1 0191740 |
| Jan. 15, 2009 | (CN) | 2009 1 0000260 |
| Jan. 15, 2009 | (CN) | 2009 1 0000261 |
| Jan. 15, 2009 | (CN) | 2009 1 0000262 |

(51) Int. Cl.
*H04R 25/00* (2006.01)

(52) U.S. Cl. ..... 381/164; 381/337

(58) Field of Classification Search ..... 381/164, 381/337, 338; 367/140; 62/6; 455/550.1; 977/932

See application file for complete search history.

(56) References Cited

U.S. PATENT DOCUMENTS

| | | | |
|---|---|---|---|
| 1,528,774 | A | 3/1925 | Kranz |
| 3,982,143 | A | 9/1976 | Tamura et al. |
| 4,002,897 | A | 1/1977 | Kleinman et al. |
| 4,045,695 | A | 8/1977 | Itagaki et al. |
| 4,334,321 | A | 6/1982 | Edelman |
| 4,503,564 | A | 3/1985 | Edelman et al. |
| 4,641,377 | A | 2/1987 | Rush et al. |
| 4,689,827 | A | 8/1987 | Gurney, Jr. |
| 4,766,607 | A | 8/1988 | Feldman |
| 5,694,477 | A | 12/1997 | Kole |

(Continued)

FOREIGN PATENT DOCUMENTS

CN 2302622 12/1998

(Continued)

OTHER PUBLICATIONS

F. Kontomichos et al ., "A thermoacoustic device for sound reproduction", acoustics 08' Paris, Jun. 29-Jul. 4, 2008.

(Continued)

*Primary Examiner* — Fan Tsang
*Assistant Examiner* — Phylesha Dabney
(74) *Attorney, Agent, or Firm* — Altis Law Group, Inc.

(57) ABSTRACT

A thermoacoustic module includes a substrate, at least one first electrode, at least one second electrode, a sound wave generator, and at least one spacer. The sound wave generator electrically connect to, span between the at least one first electrode and the at least one second electrode. The at least one first electrode and the at least one second electrode are located on the substrate and provide support to the sound wave generator. The at least one spacer is located on the substrate, between the substrate and the sound wave generator. The at least one spacer supports the sound wave generator. An interval is defined between the sound wave generator and the substrate.

20 Claims, 28 Drawing Sheets

U.S. PATENT DOCUMENTS

| | | | |
|---|---|---|---|
| 6,473,625 | B1 | 10/2002 | Williams et al. |
| 6,777,637 | B2 | 8/2004 | Nakayama et al. |
| 6,803,116 | B2 | 10/2004 | Ikeda |
| 6,808,746 | B1 | 10/2004 | Dai et al. |
| 6,921,575 | B2 | 7/2005 | Horiuchi et al. |
| 7,045,108 | B2 | 5/2006 | Jiang et al. |
| 7,130,436 | B1 | 10/2006 | Tabata et al. |
| 7,366,318 | B2 | 4/2008 | Nevill |
| 7,393,428 | B2 | 7/2008 | Huang et al. |
| 7,474,590 | B2 | 1/2009 | Watabe et al. |
| 7,723,684 | B1 | 5/2010 | Haddon et al. |
| 7,799,163 | B1 | 9/2010 | Mau et al. |
| 2001/0005272 | A1 | 6/2001 | Buchholz |
| 2001/0048256 | A1 | 12/2001 | Miyazaki et al. |
| 2002/0076070 | A1 | 6/2002 | Yoshikawa et al. |
| 2003/0038925 | A1 | 2/2003 | Choi |
| 2003/0152238 | A1 | 8/2003 | Daly |
| 2003/0165249 | A1 | 9/2003 | Higuchi |
| 2004/0053780 | A1 | 3/2004 | Jiang et al. |
| 2005/0006801 | A1 | 1/2005 | Kinloch et al. |
| 2005/0036905 | A1 | 2/2005 | Gokturk |
| 2005/0040371 | A1 | 2/2005 | Watanabe et al. |
| 2005/0201575 | A1 | 9/2005 | Koshida et al. |
| 2006/0072770 | A1 | 4/2006 | Miyazaki |
| 2006/0104451 | A1 | 5/2006 | Browning et al. |
| 2006/0147081 | A1 | 7/2006 | Mango, III et al. |
| 2006/0264717 | A1 | 11/2006 | Pesach et al. |
| 2007/0145335 | A1 | 6/2007 | Anazawa |
| 2007/0164632 | A1 | 7/2007 | Adachi et al. |
| 2007/0166223 | A1 | 7/2007 | Jiang et al. |
| 2007/0176498 | A1 | 8/2007 | Sugiura et al. |
| 2008/0063860 | A1 | 3/2008 | Song et al. |
| 2008/0095694 | A1 | 4/2008 | Nakayama et al. |
| 2008/0170982 | A1 | 7/2008 | Zhang et al. |
| 2008/0248235 | A1 | 10/2008 | Feng et al. |
| 2008/0260188 | A1 | 10/2008 | Kim |
| 2008/0299031 | A1 | 12/2008 | Liu et al. |
| 2009/0016951 | A1 | 1/2009 | Kawabata et al. |
| 2009/0028002 | A1 | 1/2009 | Sugiura et al. |
| 2009/0045005 | A1 | 2/2009 | Byon et al. |
| 2009/0085461 | A1 | 4/2009 | Feng et al. |
| 2009/0096346 | A1 | 4/2009 | Liu et al. |
| 2009/0096348 | A1 | 4/2009 | Liu et al. |
| 2009/0145686 | A1 | 6/2009 | Watabe et al. |
| 2009/0153012 | A1 | 6/2009 | Liu et al. |
| 2009/0167136 | A1 | 7/2009 | Liu et al. |
| 2009/0167137 | A1 | 7/2009 | Liu et al. |
| 2009/0196981 | A1 | 8/2009 | Liu et al. |
| 2009/0232336 | A1 | 9/2009 | Pahl |
| 2010/0054502 | A1 | 3/2010 | Miyachi |
| 2010/0054507 | A1 | 3/2010 | Oh et al. |
| 2010/0086166 | A1 | 4/2010 | Jiang et al. |
| 2010/0166232 | A1 | 7/2010 | Liu et al. |
| 2010/0233472 | A1 | 9/2010 | Liu et al. |
| 2011/0171419 | A1 | 7/2011 | Li et al. |

FOREIGN PATENT DOCUMENTS

| | | |
|---|---|---|
| CN | 2425468 | 3/2001 |
| CN | 1407392 | 4/2003 |
| CN | 1443021 | 9/2003 |
| CN | 1698400 | 11/2005 |
| CN | 2779422 Y | 5/2006 |
| CN | 1787696 | 6/2006 |
| CN | 2787870 | 6/2006 |
| CN | 2798479 | 7/2006 |
| CN | 1821048 | 8/2006 |
| CN | 1886820 | 12/2006 |
| CN | 1944829 | 4/2007 |
| CN | 1982209 | 6/2007 |
| CN | 1997243 | 7/2007 |
| CN | 101239712 | 8/2008 |
| CN | 101284662 | 10/2008 |
| CN | 201150134 | 11/2008 |
| CN | 101314464 | 12/2008 |
| CN | 101471213 | 7/2009 |
| CN | 101715155 | 5/2010 |
| CN | 101400198 | 9/2010 |
| JP | 49-24593 | 3/1974 |
| JP | 58-9822 | 1/1983 |
| JP | 58-19491 | 2/1983 |
| JP | 60-22900 | 2/1985 |
| JP | 61-294786 | 12/1986 |
| JP | 1-255398 | 10/1989 |
| JP | 3-147497 | 6/1991 |
| JP | 4-126489 | 4/1992 |
| JP | 6-33390 | 4/1994 |
| JP | 7-282961 | 10/1995 |
| JP | 8-20868 | 1/1996 |
| JP | 9-105788 | 4/1997 |
| JP | 11-282473 | 10/1999 |
| JP | 11-300274 | 11/1999 |
| JP | 2001333493 | 11/2001 |
| JP | 2002-186097 | 6/2002 |
| JP | 2002-352940 | 12/2002 |
| JP | 2002346996 | 12/2002 |
| JP | 2002542136 | 12/2002 |
| JP | 2003500325 | 1/2003 |
| JP | 2003-154312 | 5/2003 |
| JP | 2003198281 | 7/2003 |
| JP | 2003-266399 | 9/2003 |
| JP | 2003-319490 | 11/2003 |
| JP | 2003-319491 | 11/2003 |
| JP | 2003-332266 | 11/2003 |
| JP | 2003-343867 | 12/2003 |
| JP | 20042103 | 1/2004 |
| JP | 2004-107196 | 4/2004 |
| JP | 2004229250 | 8/2004 |
| JP | 2005-20315 | 1/2005 |
| JP | 2005-51284 | 2/2005 |
| JP | 2005-73197 | 3/2005 |
| JP | 2005-97046 | 4/2005 |
| JP | 2005189322 | 7/2005 |
| JP | 2005-235672 | 9/2005 |
| JP | 2005-318040 | 11/2005 |
| JP | 2005-534515 | 11/2005 |
| JP | 2005-341554 | 12/2005 |
| JP | 2005333601 | 12/2005 |
| JP | 2006-93932 | 4/2006 |
| JP | 2006-180082 | 7/2006 |
| JP | 2006-202770 | 8/2006 |
| JP | 2006-217059 | 8/2006 |
| JP | 2006270041 | 10/2006 |
| JP | 2007-24688 | 2/2007 |
| JP | 2007-54831 | 3/2007 |
| JP | 2007-167118 | 7/2007 |
| JP | 2007-174220 | 7/2007 |
| JP | 2007-187976 | 7/2007 |
| JP | 2007-196195 | 8/2007 |
| JP | 2007-228299 | 9/2007 |
| JP | 2007-527099 | 9/2007 |
| JP | 2008-62644 | 3/2008 |
| JP | 2008-101910 | 5/2008 |
| JP | 2008-153042 | 7/2008 |
| JP | 2008-163535 | 7/2008 |
| JP | 2008-269914 | 11/2008 |
| JP | 2009-31031 | 2/2009 |
| JP | 2009-91239 | 4/2009 |
| JP | 2009-94074 | 4/2009 |
| JP | 2009-146896 | 7/2009 |
| JP | 2009-146898 | 7/2009 |
| JP | 2009-164125 | 7/2009 |
| JP | 2009-184907 | 8/2009 |
| JP | 2009-184908 | 8/2009 |
| KR | 10-0761548 | 9/2007 |
| TW | 200726290 | 7/2007 |
| TW | 200740976 | 11/2007 |
| TW | 200744399 | 12/2007 |
| TW | 200833862 | 8/2008 |
| TW | 200950569 | 12/2009 |
| TW | 201029481 | 8/2010 |
| WO | WO0073204 | 12/2000 |
| WO | WO2004012932 | 2/2004 |
| WO | WO2005102924 | 11/2005 |
| WO | WO2005120130 | 12/2005 |
| WO | WO2007043837 | 4/2007 |
| WO | WO2007049496 | 5/2007 |

| | | |
|---|---|---|
| WO | WO2007052928 | 5/2007 |
| WO | WO2007099975 | 9/2007 |
| WO | WO2007111107 | 10/2007 |
| WO | WO2008/029451 | 3/2008 |

OTHER PUBLICATIONS

Lin Xiao et al., "Flexible, stretchable, transparent carbon nanotube thin film loudspeakers" vol. 8, No. 12, pp. 4539-4545 ,2008.

Silvanus P. Thompson, The Photophone, Nature, Sep. 23, 1880, vol. XXII, No. 569, pp. 481.

Alexander Graham Bell, Selenium and the Photophone, Nature, Sep. 23, 1880, pp. 500-503.

Lee et al., Photosensitization of nonlinear scattering and photoacoustic emission from single-walled carbon nanotubes, Applied Physics Letters, Mar. 13, 2008, 92, 103122.

P.M. Ajayan et al., "Nanotubes in a flash-Ignition and reconstruction", Science, vol. 296, pp. 705, Apr. 26, 2002.

F.Kontomichos et al., "A thermoacoustic device for sound reproduction", acoustics 08 Paris, pp. 4349-4353, Jun. 29-Jul. 4, 2008.

Chen, Huxiong; Diebold, Gerald, "Chemical Generation of Acoustic Waves: A Giant Photoacoustic Effect", Nov. 10, 1995, Science, vol. 270, pp. 963-966.

Amos, S.W.; "Principles of Transistor Circuits"; 2000; Newnes-Butterworth-Heinemann; 9th ed.;p. 114.

Strutt John William, Rayleigh Baron, The Theory of Sound, 1926, pp. 226-235, vol. 2.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

William Henry Preece, On Some Thermal Effects of Electric Currents, Proceedings of the Royal Society of London, 1879-1880, pp. 408-411, vol. 30.

J.J.Hopfield, Spectra of Hydrogen, Nitrogen and Oxygen in the Extreme Ultraviolet, Physical Review, 1922, pp. 573-588,vol. 20.

http://www.physorg.com/news123167268.html , 2010.

P. De Lange, On Thermophones, Proceedings of the Royal Society of London. Series A, Apr. 1, 1915, pp. 239-241, vol. 91, No. 628.

Edward C. Wente, The Thermophone, Physical Review, 1922, pp. 333-345,vol. 19.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Braun Ferdinand, Notiz uber Thermophonie, Ann. Der Physik, Apr. 1898, pp. 358-360,vol. 65.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Kaili Jiang, Qunqing Li, Shoushan Fan, Spinning continuous carbon nanotube yarns, Nature, Oct. 24, 2002, pp. 801, vol. 419.

Swift Gregory W., Thermoacoustic Engines and Refrigerators, Physics Today, Jul. 1995, pp. 22-28, vol. 48.

H.D. Arnold, I.B. Crandall, The Thermophone as a Precision Source of Sound, Physical Review, 1917, pp. 22-38, vol. 10.

W. Yi L.Lu' Zhang Dianlin et al., Linear Specific Heat of Carbon Nanotubes, Physical Review B, Apr. 1, 1999, vol. 59, No. 14, R9015-9018.

Zhuangchun Wu, Zhihong Chen, Xu Du et al.,Transparent, Conductive Carbon Nanotube Films, Science, Aug. 27, 2004, pp. 1273-1276, vol. 305.

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

Frank P. Incropera, David P. Dewitt et al., Fundamentals of Heat and Mass Transfer, 6th ed., 2007, pp. A-5, Wiley:Asia.

THERMOACOUSTIC MODULE, THERMOACOUSTIC DEVICE, AND METHOD FOR MAKING THE SAME

RELATED APPLICATIONS

This application claims all benefits accruing under 35 U.S.C. §119 from China Patent Application No. 200910000260.8, filed on Jan. 15, 2009; 200910000261.2, filed on Jan. 15, 2009; 200910000262.7, Jan. 15, 2009; 200810191732.8, filed on Dec. 30, 2008; 200810191739.X, filed on Dec. 30, 2008; 200810191731.3, filed on Dec. 30, 2008; 200810191740.2, filed on Dec. 30, 2008, in the China Intellectual Property Office. This application is related to copending application Ser. No. 12/655,375, filed on Dec. 30, 2009, entitled, "THERMOACOUSTIC DEVICE". This application is a continuation of U.S. patent application Ser. No. 12/655,415, filed on Dec. 30, 2009, entitled, "THERMOACOUSTIC MODULE, THERMOACOUSTIC DEVICE, AND METHOD FOR MAKING THE SAME".

BACKGROUND

1. Technical Field

The present disclosure relates to acoustic devices and, particularly, to thermoacoustic modules, thermoacoustic devices and method for making the same.

2. Description of Related Art

An acoustic device generally includes an electrical signal output device and a loudspeaker. The electrical signal output device inputs electrical signals into the loudspeaker. The loudspeaker receives the electrical signals and then transforms them into sounds.

There are different types of loudspeakers that can be categorized according by their working principles, such as electro-dynamic loudspeakers, electromagnetic loudspeakers, electrostatic loudspeakers and piezoelectric loudspeakers. However, the various types ultimately use mechanical vibration to produce sound waves, in other words they all achieve "electro-mechanical-acoustic" conversion. Among the various types, the electro-dynamic loudspeakers are most widely used. However, the electro-dynamic loudspeakers are dependent on magnetic fields and often weighty magnets. The structures of the electric-dynamic loudspeakers are complicated. The magnet of the electric-dynamic loudspeakers may interfere or even destroy other electrical devices near the loudspeakers.

Thermoacoustic effect is a conversion of heat to acoustic signals. The thermoacoustic effect is distinct from the mechanism of the conventional loudspeaker, which the pressure waves are created by the mechanical movement of the diaphragm. When signals are inputted into a thermoacoustic element, heating is produced in the thermoacoustic element according to the variations of the signal and/or signal strength. Heat is propagated into surrounding medium. The heating of the medium causes thermal expansion and produces pressure waves in the surrounding medium, resulting in sound wave generation. Such an acoustic effect induced by temperature waves is commonly called "the thermoacoustic effect".

A thermophone based on the thermoacoustic effect was created by H. D. Arnold and I. B. Crandall (H. D. Arnold and I. B. Crandall, "The thermophone as a precision source of sound", Phys. Rev. 10, pp 22-38 (1917)). They used platinum strip with a thickness of $7\times10^{-5}$ cm as a thermoacoustic element. The heat capacity per unit area of the platinum strip with the thickness of $7\times10^{-5}$ cm is $2\times10^{-4}$ J/cm$^2$*K. However, the thermophone adopting the platinum strip, listened to the open air, sounds extremely weak because the heat capacity per unit area of the platinum strip is too high.

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. Fan et al. discloses a thermoacoustic device with simpler structure and smaller size, working without the magnet in an article of "Flexible, Stretchable, Transparent Carbon Nanotube Thin Film Loudspeakers", Fan et al., Nano Letters, Vol. 8 (12), 4539-4545 (2008). The thermoacoustic device includes a sound wave generator which is a carbon nanotube film. The carbon nanotube film used in the thermoacoustic device has a large specific surface area, and extremely small heat capacity per unit area that make the sound wave generator emit sound audible to humans. The sound has a wide frequency response range. Accordingly, the thermoacoustic device adopted the carbon nanotube film has a potential to be actually used instead of the loudspeakers in prior art.

However, the carbon nanotube film used in the thermoacoustic device has a small thickness and a large area, and is likely to be damaged by the external forces applied thereon.

What is needed, therefore, is to provide a thermoacoustic device with a protected carbon nanotube film and a high efficiency while maintaining an efficient thermoacoustic effect.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Thermoacoustic Device

Figure 1:
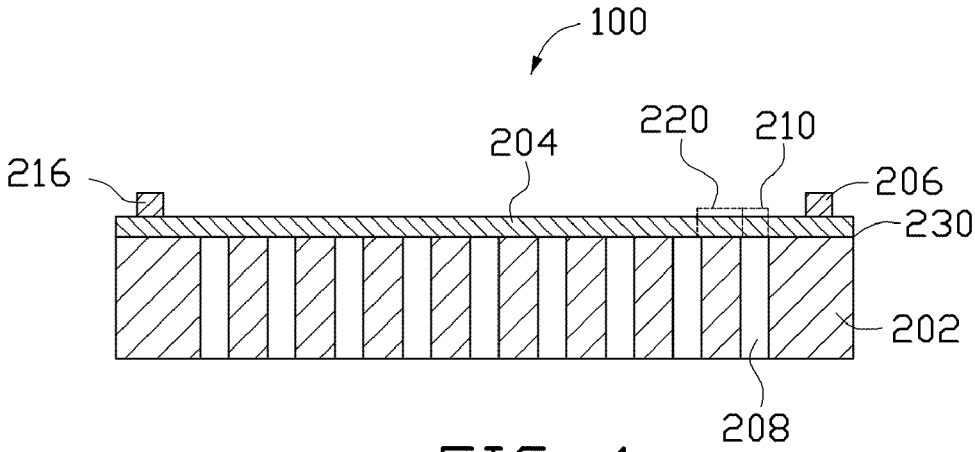
FIG. 1 is a cross-sectional view of one embodiment of a thermoacoustic module.

A thermoacoustic device in one embodiment comprises of a thermoacoustic module, and the thermoacoustic module comprises of a sound wave generator 204. The sound wave generator 204 is capable of producing sounds by a thermoacoustic effect.

Sound Wave Generator

The sound wave generator 204 has a very small heat capacity per unit area. The heat capacity per unit area of the sound wave generator 204 is less than $2\times10^{-4}$ J/cm$^2$*K. The sound wave generator 204 can be a conductive structure with a small heat capacity per unit area and a small thickness. The sound wave generator 204 can have a large specific surface area for causing the pressure oscillation in the surrounding medium by the temperature waves generated by the sound wave generator 204. The sound wave generator 204 can be a free-standing structure. The term "free-standing" includes, but is not limited to, a structure that does not have to be supported by a substrate and can sustain the weight of it when it is hoisted by a portion thereof without any significant damage to its structural integrity. The suspended part of the sound wave generator 204 will have more sufficient contact with the surrounding medium (e.g., air) to have heat exchange with the surrounding medium from both sides of the sound wave generator 204. The sound wave generator 204 is a thermoacoustic film.

The sound wave generator 204 can be or include a free-standing carbon nanotube structure. The carbon nanotube structure may have a film structure. The thickness of the carbon nanotube structure may range from about 0.5 nanometers to about 1 millimeter. The carbon nanotubes in the carbon nanotube structure are combined by van der Waals attractive force therebetween. The carbon nanotube structure has a large specific surface area (e.g., above 30 m$^2$/g). The larger the specific surface area of the carbon nanotube structure, the smaller the heat capacity per unit area will be. The smaller the heat capacity per unit area, the higher the sound pressure level of the sound produced by the sound wave generator 204.

The carbon nanotube structure can include at least one carbon nanotube film.

The carbon nanotube film can be a flocculated carbon nanotube film formed by a flocculating method. The flocculated carbon nanotube film can include a plurality of long, curved, disordered carbon nanotubes entangled with each other. A length of the carbon nanotubes can be greater than 10 centimeters. Further, the flocculated carbon nanotube film can be isotropic. The carbon nanotubes can be substantially uniformly distributed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure. The flocculated carbon nanotube film, in some embodiments, will not require the use of structural support due to the carbon nanotubes being entangled and adhered together by van der Waals attractive force therebetween.

The carbon nanotube film can also be a drawn carbon nanotube film formed by drawing a film from a carbon nanotube array that is capable of having a film drawn therefrom. The heat capacity per unit area of the drawn carbon nanotube film can be less than or equal to about $1.7\times10^{-6}$ J/cm$^2$*K. The drawn carbon nanotube film can have a large specific surface area (e.g., above 100 m$^2$/g). In one embodiment, the drawn carbon nanotube film has a specific surface area in the range of about 200 m$^2$/g to about 2600 m$^2$/g. In one embodiment, the drawn carbon nanotube film has a specific weight of about 0.05 g/m$^2$.

The thickness of the drawn carbon nanotube film can be in a range from about 0.5 nanometers to about 50 nanometers. When the thickness of the drawn carbon nanotube film is small enough (e.g., smaller than 10 μm), the drawn carbon nanotube film is substantially transparent.

Figure 4:
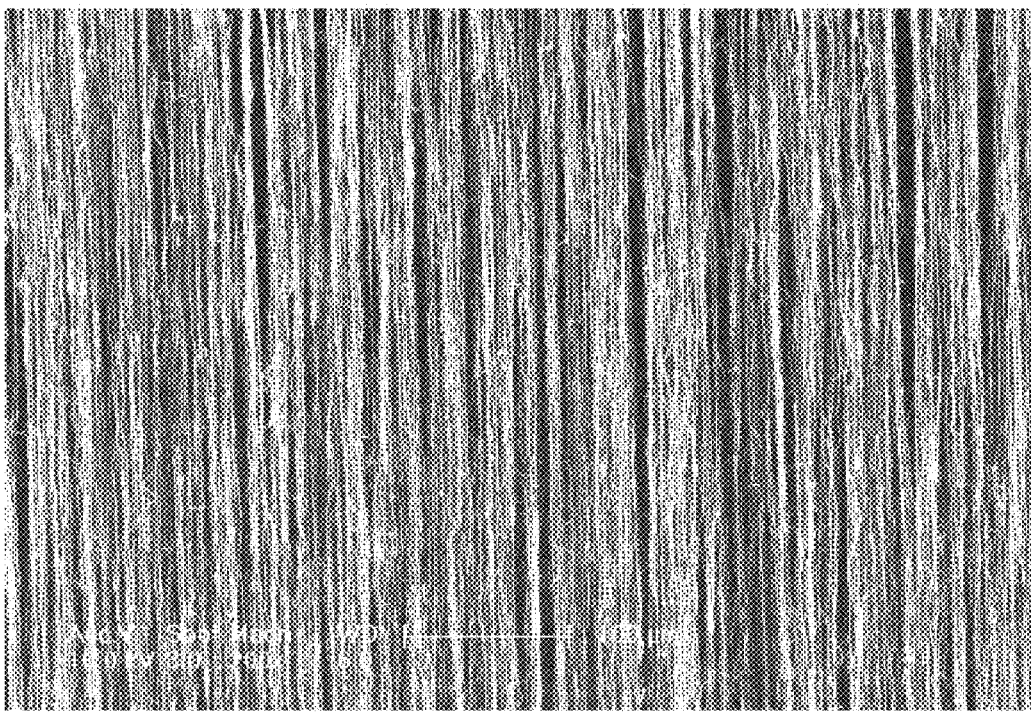
FIG. 4 shows a Scanning Electron Microscope (SEM) image of a drawn carbon nanotube film.

Referring to FIG. 4, the drawn carbon nanotube film includes a plurality of successive and oriented carbon nanotubes joined end-to-end by van der Waals attractive force therebetween. The carbon nanotubes in the drawn carbon nanotube film can be substantially aligned along a single direction and substantially parallel to the surface of the carbon nanotube film. As can be seen in FIG. 4, some variations can occur in the drawn carbon nanotube film. The drawn carbon nanotube film is a free-standing film. The drawn carbon nanotube film can be formed by drawing a film from a carbon nanotube array that is capable of having a carbon nanotube film drawn therefrom.

The carbon nanotube structure can include more than one carbon nanotube films. The carbon nanotube films in the carbon nanotube structure can be coplanar and/or stacked. Coplanar carbon nanotube films can also be stacked one upon other coplanar films. Additionally, an angle can exist between the orientation of carbon nanotubes in adjacent films, stacked and/or coplanar. Adjacent carbon nanotube films can be combined by only the van der Waals attractive force therebetween without the need of an additional adhesive. The number of the layers of the carbon nanotube films is not limited. However, as the stacked number of the carbon nanotube films increases, the specific surface area of the carbon nanotube structure will decrease. A large enough specific surface area (e.g., above 30 m$^2$/g) must be maintained to achieve an acceptable acoustic volume. An angle between the aligned directions of the carbon nanotubes in the two adjacent drawn carbon nanotube films can range from about 0 degrees to about 90 degrees. Spaces are defined between two adjacent carbon nanotubes in the drawn carbon nanotube film. When the angle between the aligned directions of the carbon nanotubes in adjacent drawn carbon nanotube films is larger than 0 degrees, a microporous structure is defined by the carbon nanotubes in the sound wave generator 204. The carbon nanotube structure in an embodiment employing these films will have a plurality of micropores. Stacking the carbon nanotube films will add to the structural integrity of the carbon nanotube structure.

In some embodiments, the sound wave generator 204 is a single drawn carbon nanotube film drawn from the carbon nanotube array. The drawn carbon nanotube film has a thickness of about 50 nanometers, and has a transmittance of visible lights in a range from 67% to 95%.

Figure 50:
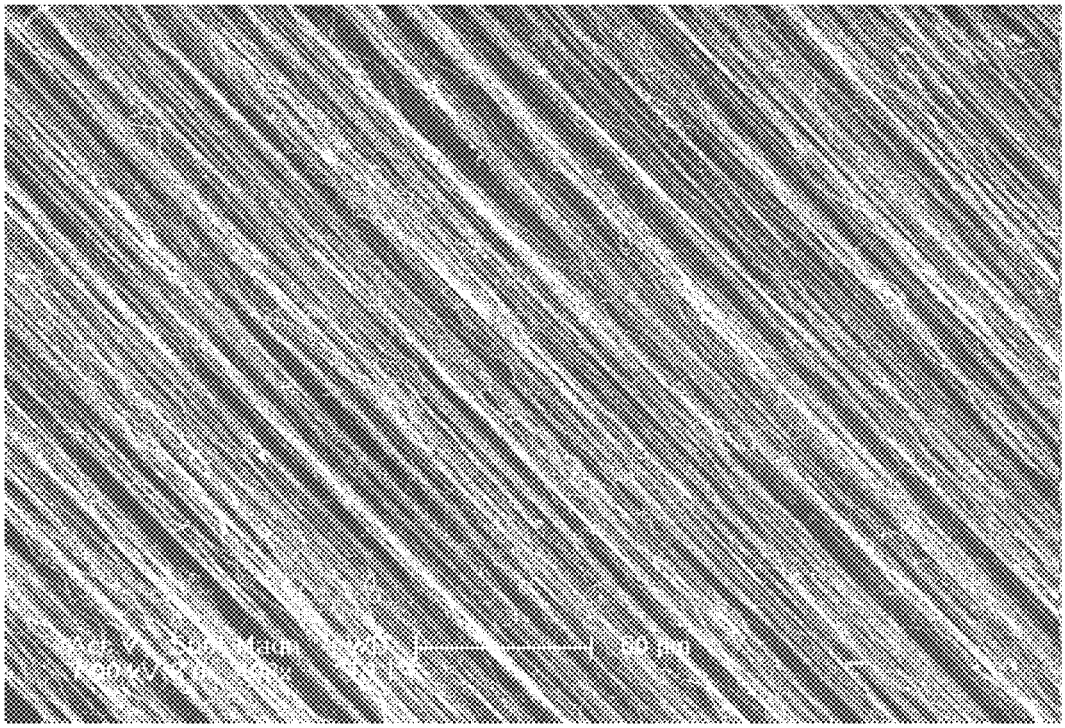
FIG. 50 shows an SEM image of a carbon nanotube composite film.
Figure 51:
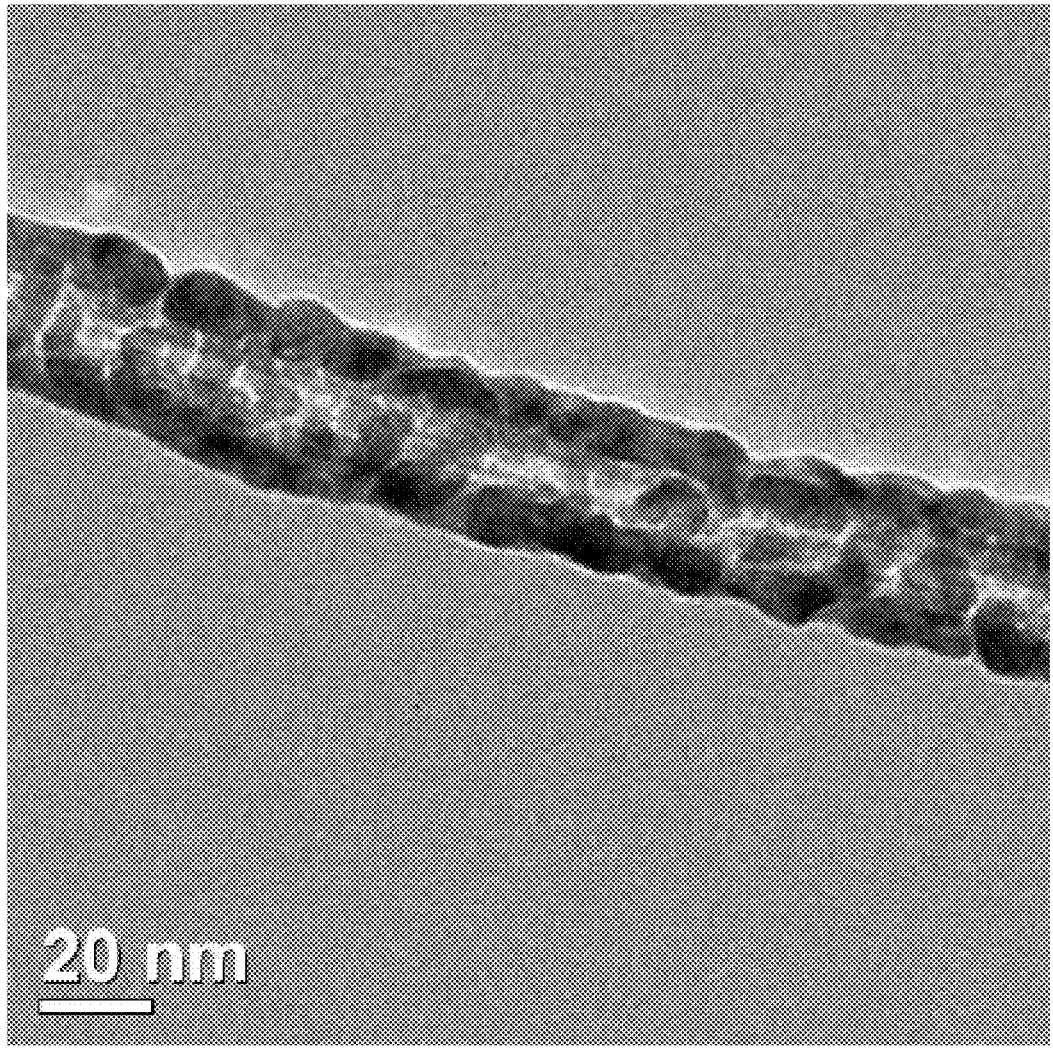
FIG. 51 shows a Transmission Electron Microscope (TEM) image of a carbon nanotube-conductive material composite.

In other embodiments, the sound wave generator 204 can be or include a free-standing carbon nanotube composite structure. The carbon nanotube composite structure can be formed by depositing at least a conductive layer on the outer surface of the individual carbon nanotubes in the above-described carbon nanotube structure. The carbon nanotubes can be individually coated or partially covered with conductive material. Thereby, the carbon nanotube composite structure can inherit the properties of the carbon nanotube structure such as the large specific surface area, the high transparency, the small heat capacity per unit area. Further, the conductivity of the carbon nanotube composite structure is greater than the pure carbon nanotube structure. Thereby, the driven voltage of the sound wave generator 204 using a coated carbon nanotube composite structure will be decreased. The conductive material can be placed on the carbon nanotubes by using a method of vacuum evaporation, spattering, chemical vapor deposition (CVD), electroplating, or electroless plating. A microscopic view of the carbon nanotube composite structure formed from a single drawn carbon nanotube film with layers of conductive material thereon is shown in FIGS. 50 and 51.

Figure 49:
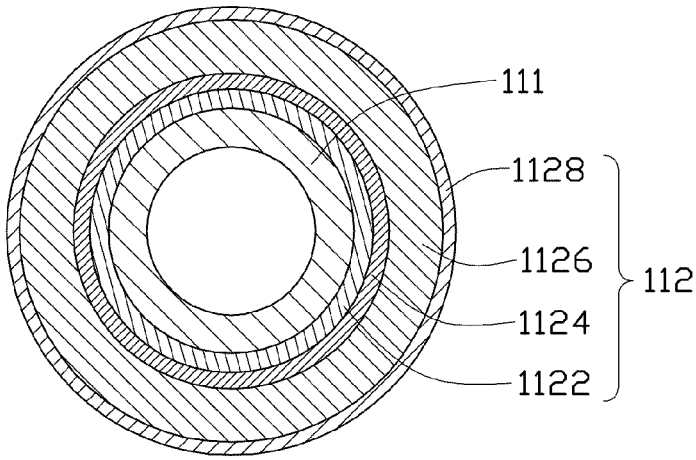
FIG. 49 is a schematic view of a carbon nanotube with four layers of conductive material thereon.

The material of the conductive material can comprise of iron (Fe), cobalt (Co), nickel (Ni), palladium (Pd), titanium (Ti), copper (Cu), silver (Ag), gold (Au), platinum (Pt), and combinations thereof. The thickness of the layer of conductive material can be ranged from about 1 nanometer to about 100 nanometers. In some embodiments, the thickness of the layer of conductive material can be less than about 20 nanometers. More specifically, referring to FIG. 49, the at least one layer of conductive material 112 can, from inside to outside, include a wetting layer 1122, a transition layer 1124, a conductive layer 1126, and an anti-oxidation layer 1128. The wetting layer 1122 is the innermost layer and contactingly covers the surface of the carbon nanotube 111. The transition layer 1124 enwraps the wetting layer 1122. The conductive layer 1126 enwraps the transition layer 1124. The anti-oxidation layer 1128 enwraps the conductive layer 1126. The wetting layer 1122 wets the carbon nanotubes 111. The transition layer 1124 wets both the wetting layer 1122 and the conductive layer 1126, thus combining the wetting layer 1122 with the conductive layer 1126. The conductive layer 1126 has high conductivity. The anti-oxidation layer 1128 prevents the conductive layer 1126 from being oxidized by exposure to the air and prevents reduction of the conductivity of the carbon nanotube composite film.

In one embodiment, the carbon nanotube structure is a drawn carbon nanotube film, the at least one layer of conductive material 112 comprises a Ni layer located on the outer surface of the carbon nanotube 111 and is used as the wetting layer 1122. An Au layer is located on the Ni layer and used as the conductive layer 1126. The thickness of the Ni layer is about 2 nanometers. The thickness of the Au layer is about 15 nanometers.

The sound wave generator 204 has a small heat capacity per unit area, and a large surface area for causing the pressure oscillation in the surrounding medium by the temperature waves generated by the sound wave generator 204. In use, when electrical or electromagnetic wave signals 250, with variations in the application of the signals and/or strength applied to the sound wave generator 204, repeated heating is produced by the sound wave generator 204 according to the variations of the signals and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the sound wave generator 204 that produces sound. This is distinct from the mechanism of the conventional loudspeaker, in which the pressure waves are created by the mechanical movement of the diaphragm. There is an "electrical-thermal-sound" conversion when the electrical signals are applied on the sound wave generator 204 through electrodes 206, 216; and there is an "optical-thermal-sound" conversion when electromagnetic wave signals 250 emitted from an electromagnetic wave device 240 are applied on the sound wave generator 204. The conversions of "electrical-thermal-sound" and "optical-thermal-sound" are all belonged to a thermoacoustic principle.

Electrode

The thermoacoustic module can further include at least one first electrode 206 and at least one second electrode 216. The first electrode 206 and the second electrode 216 are in electrical contact with the sound wave generator 204, and input electrical signals into the sound wave generator 204.

The first electrode 206 and the second electrode 216 are made of conductive material. The shape of the first electrode 206 or the second electrode 216 is not limited and can be lamellar, rod, wire, and block among other shapes. A material of the first electrode 206 or the second electrode 216 can be metals, conductive adhesives, carbon nanotubes, and indium tin oxides among other conductive materials. The first electrode 206 and the second electrode 216 can be metal wire or conductive material layers, such as metal layers formed by a sputtering method, or conductive paste layers formed by a method of screen-printing.

The first electrode 206 and the second electrode 216 can be electrically connected to two terminals of an electrical signal input device (such as a MP3 player) by a conductive wire. Thereby, electrical signals output from the electrical signal device can be input into the sound wave generator 204 through the first and second electrodes 206, 216.

A conductive adhesive layer can be further provided between the first and second electrodes 206, 216 and the sound wave generator 204. The conductive adhesive layer can be applied to a surface of the sound wave generator 204. The conductive adhesive layer can be used to provide better electrical contact and attachment between the first and second electrodes 206, 216 and the sound wave generator 204. In one embodiment, the conductive adhesive layer is a layer of silver paste.

In one embodiment, the sound wave generator 204 is a drawn carbon nanotube film drawn from the carbon nanotube array, and the carbon nanotubes in the carbon nanotube film are aligned along a direction from the first electrode 206 to the second electrode 216. The first electrode 206 and the second electrode 216 can both have a length greater than or equal to the carbon nanotube film width.

In one embodiment, the thermoacoustic module can include a plurality of alternatively arranged first and second electrodes 206, 216. The first electrodes 206 and the second electrodes 216 can be arranged as a staggered manner of +−+−. All the first electrodes 206 are electrically connected together, and all the second electrodes 216 are electrically connected together, whereby the sections of the sound wave generator 204 between the adjacent first electrode 206 and the second electrode 216 are in parallel. An electrical signal is conducted in the sound wave generator 204 from the first electrodes 206 to the second electrodes 216. By placing the sections in parallel, the resistance of the thermoacoustic module is decreased. Therefore, the driving voltage of the thermoacoustic module can be decreased with the same effect.

The first electrodes 206 and the second electrodes 216 can be substantially parallel to each other with a same distance between the adjacent first electrode 206 and the second electrode 216. In some embodiments, the distance between the adjacent first electrode 206 and the second electrode 216 can be in a range from about 1 millimeter to about 3 centimeters.

Figure 47:
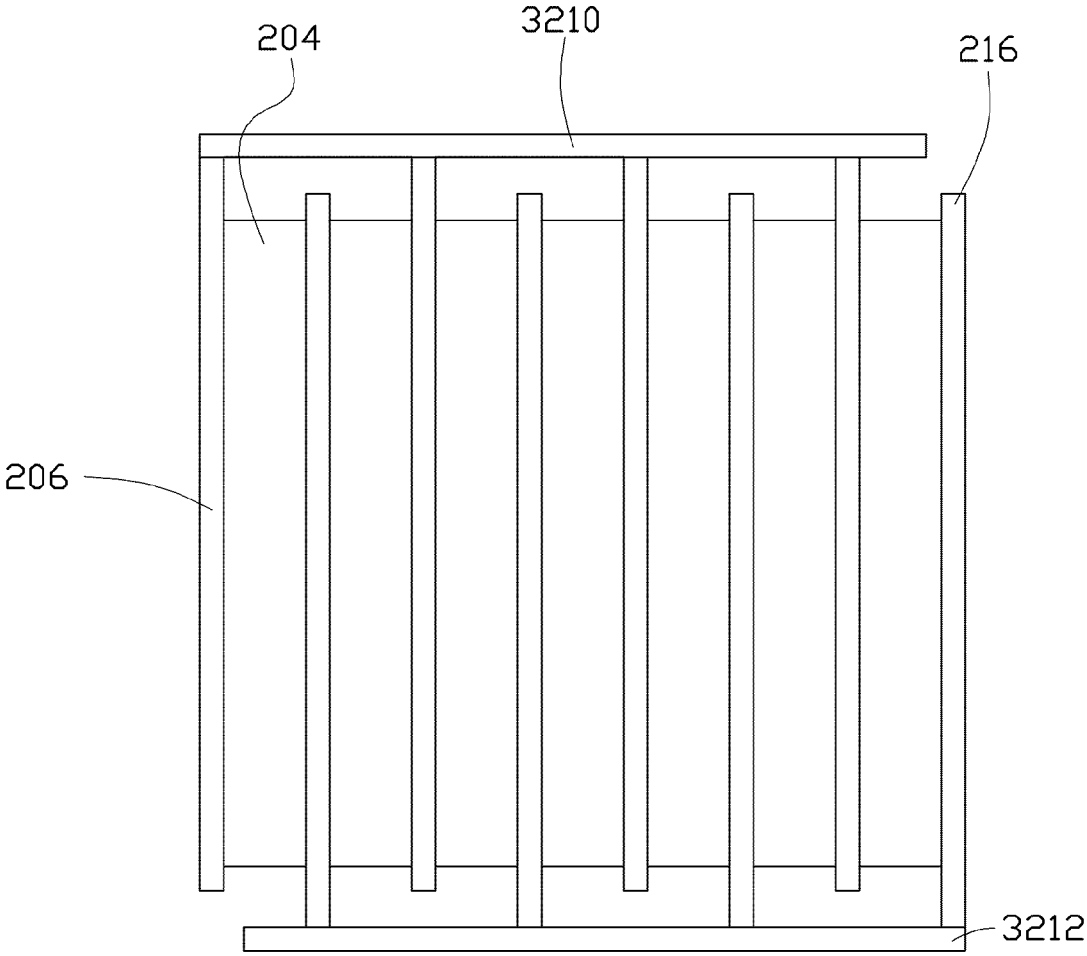
FIG. 47 is a schematic top plan view of one embodiment of a thermoacoustic module.

To connect all the first electrodes 206 together, and connect all the second electrodes 216 together, first conducting member 3210 and second conducting member 3212 can be arranged. Referring to FIG. 47, all the first electrodes 206 are connected to the first conducting member 3210. All the second electrodes 216 are connected to the second conducting member 3212. The sound wave generator 204 is divided by the first and second electrodes 206, 216 into many sections. The sections of the sound wave generator 204 between the adjacent first electrode 206 and the second electrode 216 are in parallel. An electrical signal is conducted in the sound wave generator 204 from the first electrodes 206 to the second electrodes 216.

The first conducting member 3210 and the second conducting member 3212 can be made of the same material as the first and second electrodes 206, 216, and can be perpendicular to the first and second electrodes 206, 216.

Thermoacoustic Device Using Photoacoustic Effect

Figure 14:
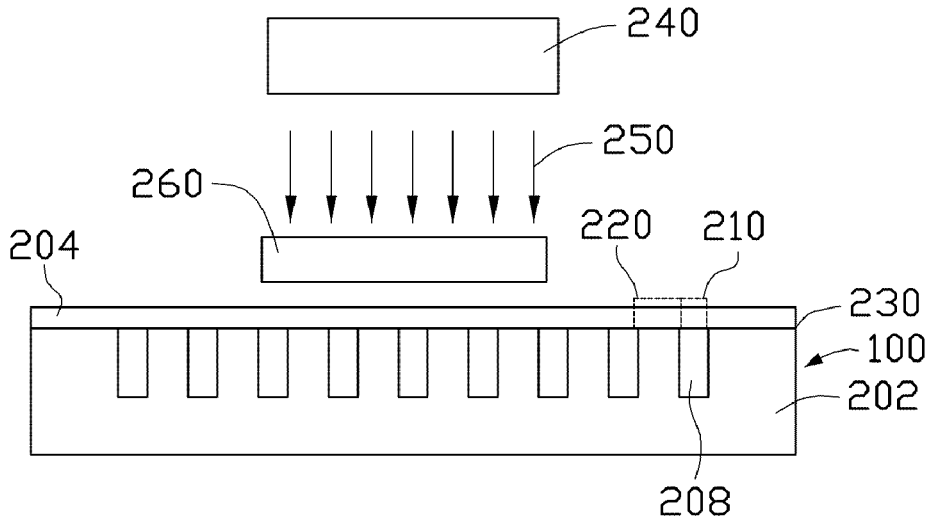
FIG. 14 is a front view of one embodiment of a thermoacoustic module.

In one embodiment, when the input signal is electromagnetic wave signal 250, the signal can be directly incident to the sound wave generator 204 but not through the first and second electrodes 206, 216, and the thermoacoustic device works under a photoacoustic effect. The photoacoustic effect is a kind of the thermoacoustic effect and a conversion between light and acoustic signals due to absorption and localized thermal excitation. When rapid pulses of light are incident on a sample of matter, the light can be absorbed and the resulting energy will then be radiated as heat. This heat causes detectable sound signals due to pressure variation in the surrounding (i.e., environmental) medium. Referring to FIG. 14, a thermoacoustic device according to an embodiment includes a thermoacoustic module 100 and an electromagnetic signal input device which is an electromagnetic wave device 240.

The thermoacoustic module 100 includes a substrate 202, and a sound wave generator 204, but without the first and second electrodes 206, 216. In the embodiment shown in FIG. 14, the substrate 202 has a top surface 230, and includes at least one recess 208 located on the top surface 230. The recess 208 defines an opening on the top surface 230. The sound wave generator 204 is located on the top surface 230 of the substrate 202 and covers the opening of the recess 208. The sound wave generator 204 includes at least one first region 210, and at least one second region 220. Each opening of the at least one recess 208 is covered by one of the first region 210. The second region 220 of the sound wave generator 204 is in contact with the surface 230 and supported by the substrate 202.

The electromagnetic wave device 240 is capable of inducing heat energy in the sound wave generator 204 thereby producing a sound by the principle of thermoacoustic.

The electromagnetic wave device 240 can be located apart from the sound wave generator 204. The electromagnetic wave device 240 can be a laser-producing device, a light source, or an electromagnetic signal generator. The electromagnetic wave device 240 can transmit electromagnetic wave signals 250 (e.g., laser signals and normal light signals) to the sound wave generator 204.

The average power intensity of the electromagnetic wave signals 250 can be in the range from about 1 $\mu W/mm^2$ to about 20 $W/mm^2$. It is to be understood that the average power intensity of the electromagnetic wave signals 250 must be high enough to cause the sound wave generator 204 to heat the surrounding medium, but not so high that the sound wave generator 204 is damaged. In some embodiments, the electromagnetic signal generator 240 is a pulse laser generator (e.g., an infrared laser diode). In other embodiments, the thermoacoustic device can further include a focusing element such as a lens (not shown). The focusing element focuses the electromagnetic wave signals 250 on the sound wave generator 204. Thus, the average power intensity of the original electromagnetic wave signals 250 can be lowered.

The incident angle of the electromagnetic wave signals 250 on the sound wave generator 204 is arbitrary. In some embodiments, the electromagnetic wave signal's direction of travel is perpendicular to the surface of the carbon nanotube structure. The distance between the electromagnetic signal generator 240 and the sound wave generator 204 is not limited as long as the electromagnetic wave signal 250 is successfully transmitted to the sound wave generator 204.

In the embodiment shown in FIG. 14, the electromagnetic wave device 240 is a laser-producing device. The laser-producing device is located apart from the sound wave generator 204 and faces to the sound wave generator 204. The laser-producing device can emit a laser. The laser-producing device faces to the sound wave generator 204. In other embodiments, when the substrate 202 is made of transparent materials, the laser-producing device can be disposed on either side of the substrate 202. The laser signals produced by the laser-producing device can transmit through the substrate 202 to the sound wave generator 204.

The thermoacoustic device can further include a modulating device 260 disposed in the transmitting path of the electromagnetic wave signals 250. The modulating device 260 can include an intensity modulating element and/or a frequency modulating element. The modulating device 260 modulates the intensity and/or the frequency of the electromagnetic wave signals 250 to produce variation in heat. In detail, the modulating device 260 can include an on/off controlling circuit to control the on and off of the electromagnetic wave signal 250. In other embodiments, the modulating device 260 can directly modulate the intensity of the electromagnetic wave signal 250. The modulating device 260 and the electromagnetic signal device can be integrated, or spaced from each other. In one embodiment, the modulating device 260 is an electro-optical crystal.

The sound wave generator 204 absorbs the electromagnetic wave signals 250 and converts the electromagnetic energy into heat energy. The heat capacity per unit area of the carbon nanotube structure is extremely small, and thus, the temperature of the carbon nanotube structure can change rapidly with the input electromagnetic wave signals 250 at the substantially same frequency as the electromagnetic wave signals 250. Thermal waves, which are propagated into surrounding medium, are obtained. Therefore, the surrounding medium, such as ambient air, can be heated at an equal frequency as the input of electromagnetic wave signal 250 to the sound wage generator 204. The thermal waves produce pressure waves in the surrounding medium, resulting in sound wave generation. In this process, it is the thermal expansion and contraction of the medium in the vicinity of the sound wave generator 204 that produces sound. The operating principle of the sound wave generator 204 is the "optical-thermal-sound" conversion.

Figure 23:
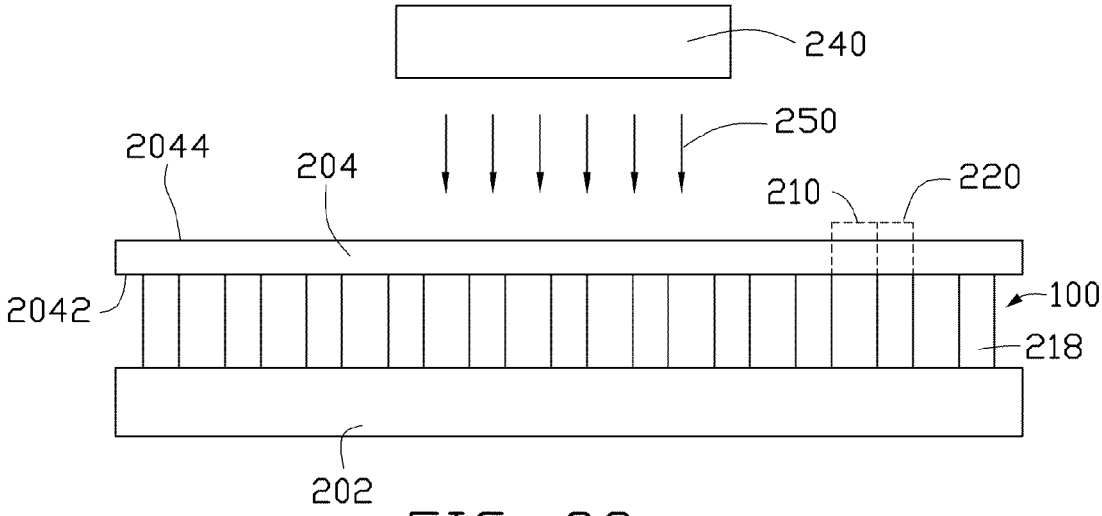
FIG. 23 is a schematic front view of one embodiment of a thermoacoustic module.

Referring to FIG. 23, in other embodiments, the thermoacoustic module 100 includes a substrate 202, a plurality of spacers 218, a sound wave generator 204. The spacers 218 are located apart from each other on the substrate 202. The sound wave generator 204 is located on and supported by the spacers 218. A plurality of spaces are defined between the sound wave generator 204, the spacers 218 and the substrate 202. The sound wave generator 204 includes at least one first region 210, and at least one second region 220. The first region 210 is suspended while the second region 220 is in contact with and supported by the spacer 218.

Substrate

Referring to FIG. 1, the thermoacoustic module 100 can further include a substrate 202, the sound wave generator 204 can be disposed on the substrate 202. The shape, thickness, and size of the substrate 202 is not limited. A top surface 230 of the substrate 202 can be planar or have a curve. A material of the substrate 202 is not limited, and can be a rigid or a flexible material. The resistance of the substrate 202 is greater than the resistance of the sound wave generator 204 to avoid a short through the substrate 202. The substrate 202 can have a good thermal insulating property, thereby preventing the substrate 202 from absorbing the heat generated by the sound wave generator 204. The material of the substrate 202 can be selected from suitable materials including, plastics, ceramics, diamond, quartz, glass, resin and wood. In one embodiment, the substrate 202 is glass square board with a thickness of the glass square board is about 20 millimeters and a length of each side of the substrate 202 is about 17 centimeters.

Drawn carbon nanotube film has a large specific surface area, and thus it is adhesive in nature. Therefore, the carbon nanotube film can directly adhere with the top surface 230 of the substrate 202. Once the carbon nanotube film is adhered to the top surface 230 of the substrate 202, the carbon nanotube film can be treated with a volatile organic solvent. Specifically, the carbon nanotube film can be treated by applying the organic solvent to the carbon nanotube film to soak the entire surface of the carbon nanotube film. The organic solvent is volatile and can be, for example, ethanol, methanol, acetone, dichloroethane, chloroform, any appropriate mixture thereof. In one embodiment, the organic solvent is ethanol. After being soaked by the organic solvent, carbon nanotube strings will be formed by adjacent carbon nanotubes in the carbon nanotube film, that are able to do so, bundling together, due to the surface tension of the organic solvent when the organic solvent volatilizes. After the organic solvent volatilizes, the contact area of the carbon nanotube film with the top surface 230 of the substrate 202 will increase, and thus, the carbon nanotube film will more firmly adhere to the top surface 230 of the substrate 202. In another aspect, due to the decrease of the specific surface area via bundling, the mechanical strength and toughness of the carbon nanotube film is increased. Macroscopically, after the organic solvent treatment, the carbon nanotube film will remain an approximately uniform film.

It is to be understood that, though the carbon nanotube film is adhesive in nature, an adhesive can also be used to adhere the carbon nanotube film with the substrate 202. In one embodiment, an adhesive layer or binder points can be located on the surface of the substrate 202. The sound wave generator 204 can be adhered on the substrate 202 via the binder layer or binder points. It is to be noted that, the sound wave generator 204 can be fixed on the top surface 230 of the substrate 202 by other means, even if the sound wave generator 204 does not directly contact with the top surface 230 of the substrate 202.

Referring to FIG. 1, the substrate 202 can further defines at least one recess 208 through the top surface 230. By provision of the recess 208, the sound wave generator 204 is divided into at least one first region 210, suspended above the recess 208, and at least one second region 220, in contact with the top surface 230 of the substrate 202. There can be more than one first region 210 and/or more than one second region 220.

The first region 210 and the second region 220 both include a plurality of carbon nanotubes. The drawn carbon nanotube film is located on the top surface 230 of the substrate 202 and covers the openings defined by the recesses 208.

The first region 210 of the sound wave generator 204 is suspended over the recess 208. Therefore, the carbon nanotube structure in the first region 210 of the sound wave generator 204 can have greater contact and heat exchange with the surrounding medium than the second region 220. Thus, the electrical-sound transforming efficiency of the thermoacoustic module 100 can be greater than when the entire sound wave generator 204 is in contact with the top surface 230 of the substrate 202. The second region 220 of the sound wave generator 204 is in contact with the top surface 230, and supported via the substrate 202. Therefore, the carbon nanotube structure of the sound wave generator 204 is supported and protected.

According to different materials of the substrate 202, the recess 208 can be formed by mechanical methods or chemical methods, such as cutting, burnishing, or etching. The substrate 202 having the recess 208 can also be achieved by using a mold with a predetermined shape.

The recess 208 can be a through groove (i.e., the recess 208 goes all the way through the substrate 202), a through hole, a blind groove (i.e., a depth of the recess 208 is less than a thickness of the substrate 202), a blind hole.

Figure 2:
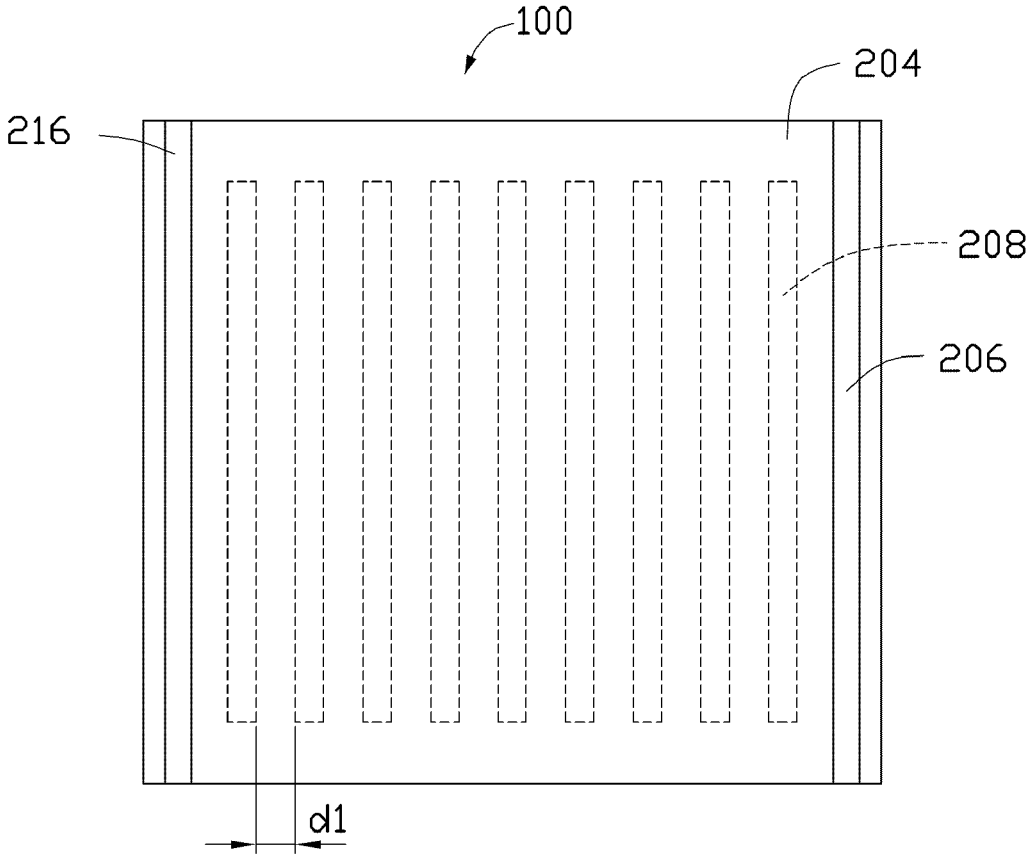
FIG. 2 is a schematic top plan view of the thermoacoustic module shown in FIG. 1.

Referring to FIGS. 1 and 2, in one embodiment, the recess 208 is a through groove. The opening defined by the recess 208 at the top surface 230 of the substrate 202 can be rectangular, polygon, flat circular, I-shaped, or any other shape. Each one of the first regions 210 covers the opening defined by each one of the recesses 208 on the top surface 230 of the substrate 202. The recesses 208 can be parallel to each other with a distance d1 between every two adjacent recesses 208. The distance d1 can be greater than about 100 microns (μm). In one embodiment, the recesses 208 have rectangular strip shaped openings (shown in FIG. 2) at the top surface 230 of the substrate 202, a width of the recess 208 is about 1 millimeter (mm), and the through groove recesses 208 are parallel to each other with a same distance of about 1 mm between every two adjacent through groove recesses 208.

Figure 3:
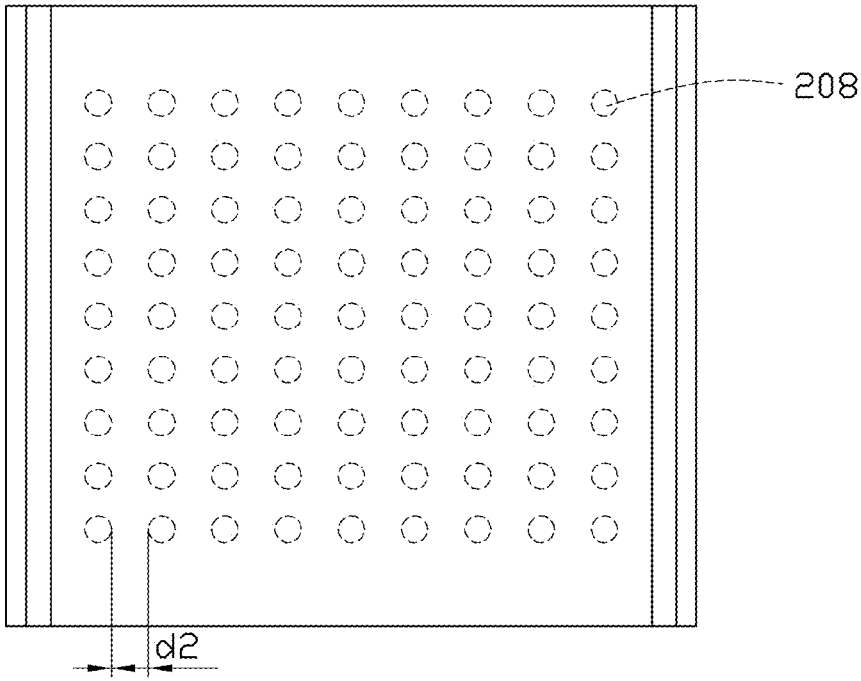
FIG. 3 is a schematic top plan view of one embodiment of a thermoacoustic module.
Figure 7:
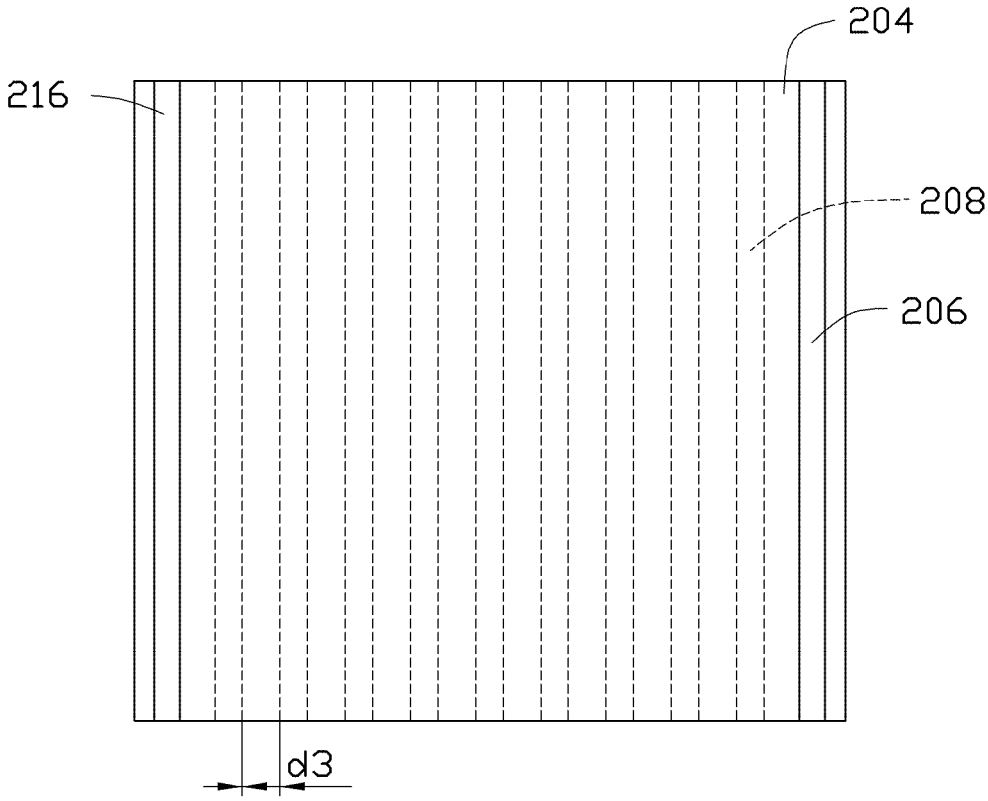
FIG. 7 is a schematic top plan view of one embodiment of a thermoacoustic module.
Figure 8:
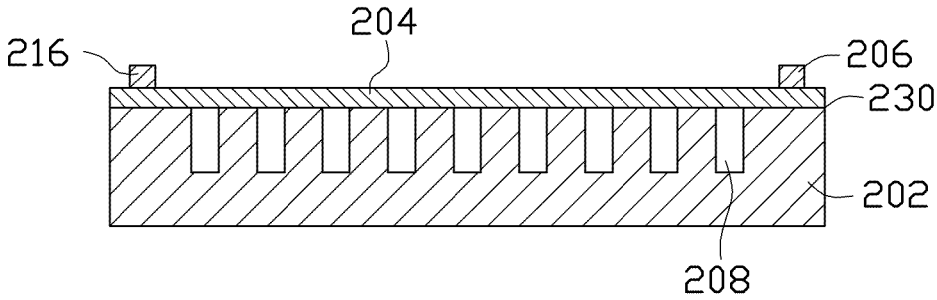
FIG. 8 is a cross-sectional view of the thermoacoustic module shown in FIG. 7.

Referring to FIG. 3, in one embodiment, each recess 208 is a round through hole. The diameter of the through hole can be about 0.5 μm. A distance d2 between two adjacent recesses 208 can be larger than 100 μm. An opening defined by the recess 208 at the top surface 230 of the substrate 202 can be round. It is to be understood that the opening defined by the recess 208 can also have be rectangular, triangle, polygon, flat circular, I-shaped, or any other shape. In other embodiments, the substrate 202 has a top surface 230 and includes at least one recess 208 located on the top surface 230. The recess 208 has a closed end. Referring to FIGS. 7 and 8, the recesses 208 can be blind grooves. The opening defined by the blind grooves on the top surface 230 of the substrate 202 can be rectangular, polygon, flat circular, I-shape, or other shape.

In one embodiment, the substrate 202 includes a plurality of blind grooves having rectangular strip shaped openings on the top surface 230 of the substrate 202. The blind grooves are parallel to each other and located apart from each other for the same distance d3. The width of the blind grooves is about 1 millimeter. The distance d3 is about 1 millimeter.

When the depth of the blind grooves or holes is greater than about 10 millimeters, the sound waves reflected by the bottom surface of the blind grooves may have a superposition with the original sound waves, which may lead to an interference cancellation. To reduce this impact, the depth of the blind grooves that can be less than about 10 millimeters. In another aspect, when the depth of the blind grooves is less than 10 microns, the heat generated by the sound wave generator 204 would be dissipated insufficiently. To reduce this impact, the depth of the blind grooves and holes can be greater than 10 microns.

Figure 9:
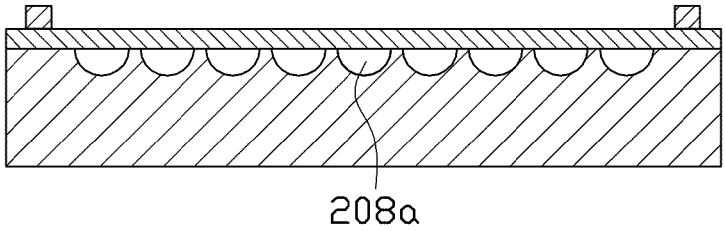
FIG. 9 is a cross-sectional view of one embodiment of a thermoacoustic module having half-sphere shaped grooves.
Figure 10:
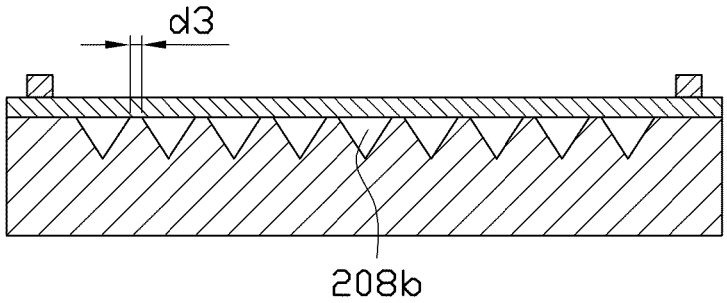
FIG. 10 is a cross-sectional view of one embodiment of a thermoacoustic module having V-sphere shaped grooves.
Figure 11:
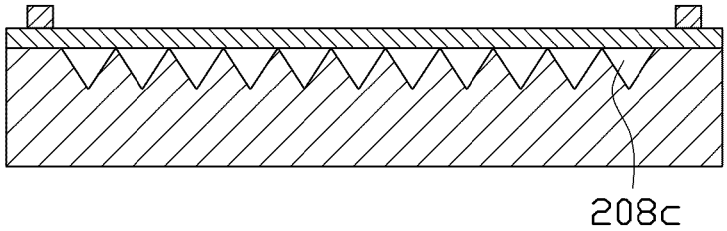
FIG. 11 is a cross-sectional view of one embodiment of a thermoacoustic module having sawtooth shaped grooves.

Alternatively, the cross-section along a direction perpendicular to the length direction of the blind grooves can be a semicircle 208*a* shown in FIG. 9. Referring to FIG. 10, the cross-section along the direction perpendicular to the length direction of the blind grooves 1 can be a triangle labeled as 208*b*, and the distance d3 can be about 1 millimeter. Referring to FIG. 11, the cross-section along a direction perpendicular to the length direction of the blind grooves 208*c* can also be a triangle, while the distance d3=0. Therefore, in the embodiment shown in FIG. 11, the regions of the surface 230 that in contact with the sound wave generator 204 are a plurality of lines. In other embodiments, the regions of the top surface 230 that in contact with the sound wave generator 204 can also be a plurality of points. In summary, the sound wave generator 204 and the top surface 230 of the substrate 202 can be in point-contacts, line-contacts, and/or multiple surface-contacts.

The blind grooves can reflect sound waves produced by the sound wave generator 204, and increase the sound pressure at the side of the substrate 202 that has the blind grooves. By decreasing the distance between adjacent blind grooves, the first region 210 is increased.

Figure 12:
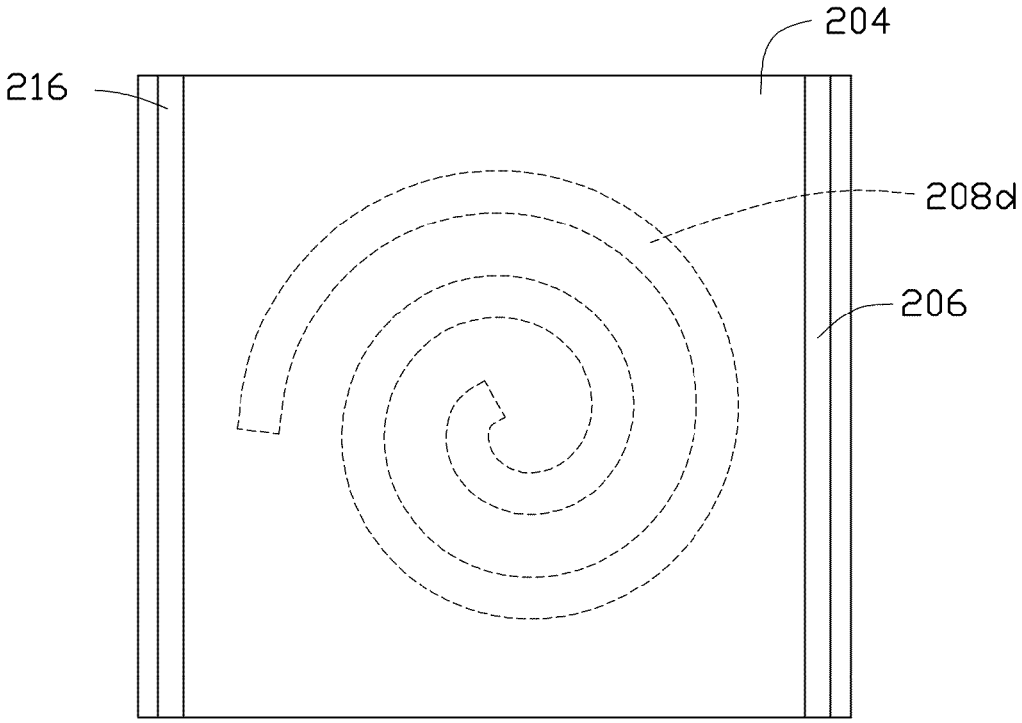
FIG. 12 is a schematic top plan view of one embodiment of a thermoacoustic module.
Figure 13:
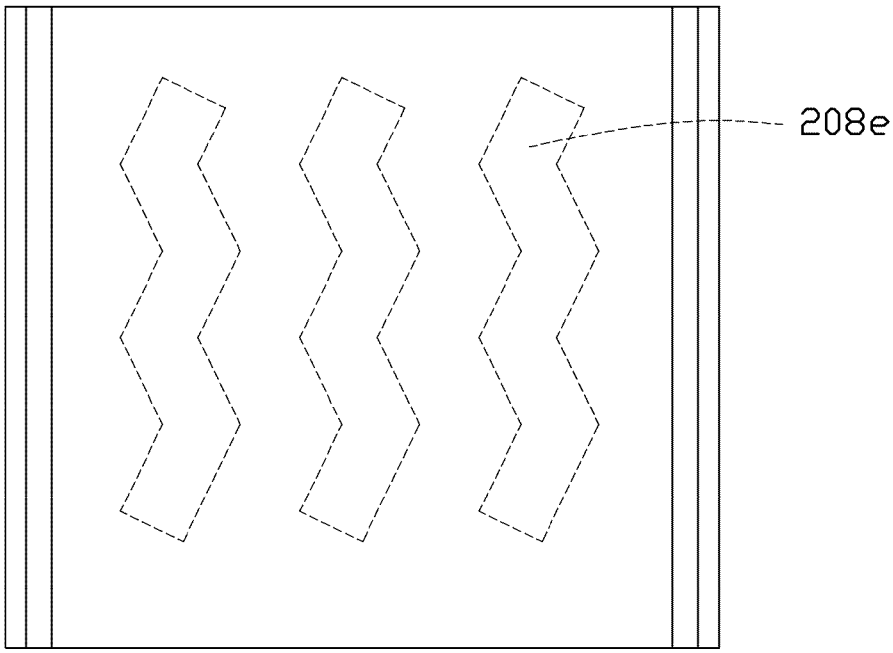
FIG. 13 is a schematic top plan view of one embodiment of a thermoacoustic module.

Referring to FIG. 12, in other embodiments, the opening of the recess 208*d* has a spiral shape. Alternatively, the openings of the recess 208*e* can have a zigzag shape shown in FIG. 13. The recesses 208*d* can be a through and/or blind groove and/or hole. It is to be understood that the opening can also have other shapes.

In other embodiment, the recesses 208*a* can be blind holes as shown in FIG. 9. The openings defined by the blind holes on the top surface 230 of the substrate 202 can be rectangles, triangles, polygons, flat circulars, I-shapes, or other shapes.

In the embodiment shown in FIGS. 1 to 3 and 7 to 13, the sound wave generator 204 is located between the electrodes 206, 216 and the substrate 202, the first electrode 206 and the second electrode 216 are located on a top surface of the sound wave generator 204. The first electrode 206 and the second electrode 216 can be metal wires parallel with each other and located on the top surface of the sound wave generator 204. The first electrode 206 and the second electrode 216 can be fixed to the sound wave generator 204.

Figure 5:
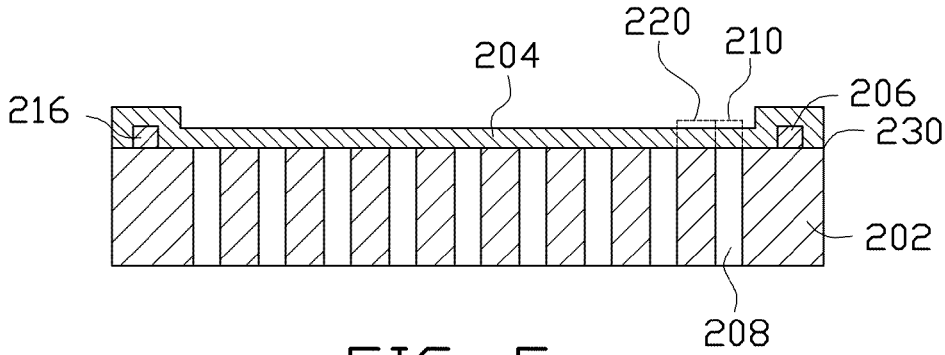
FIG. 5 is a cross-sectional view of one embodiment of a thermoacoustic module.
Figure 6:
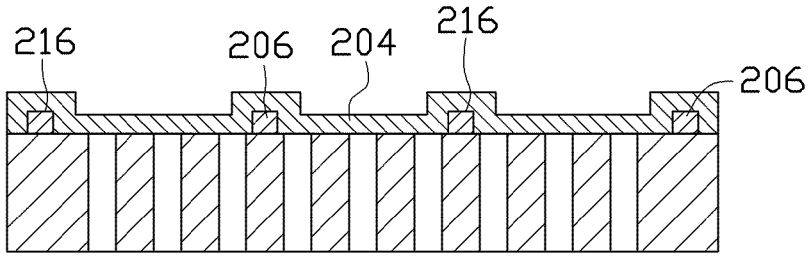
FIG. 6 is a cross-sectional view of one embodiment of a thermoacoustic module.

It is to be understood that the first and second electrodes 206, 216 can also disposed between the substrate 202 and the sound wave generator 204. Referring to FIG. 5, in other embodiments, the sound wave generator 204 is located on the top surface 230 and covers the recesses 208 and the electrodes 206, 216. In one embodiment, the first electrode 206 and the second electrode 216 are silver paste layers formed on the top surface 230 by a method of screen-printing. Referring to FIG. 6, in other embodiments, there can also be more than one first electrodes 206 and more than one second electrodes 216 located on the top surface 230 of the substrate 202, the first electrodes 206 and the second electrodes 216 are arranged as the staggered manner of +−+−.

Spacers

The sound wave generator 204 can be disposed on or separated from the substrate 202. To separate the sound wave generator 204 from the substrate 202, the thermoacoustic module can further include one or some spacers 218. The spacer 218 is located on the substrate 202, and the sound wave generator 204 is located on and partially supported by the spacer 218. An interval space is defined between the sound wave generator 204 and the substrate 202. Thus, the sound wave generator 204 can be sufficiently exposed to the surrounding medium and transmit heat into the surrounding medium, therefore the efficiency of the thermoacoustic module can be greater than having the entire sound wave generator 204 contacting with the top surface 230 of the substrate 202.

Figure 15:
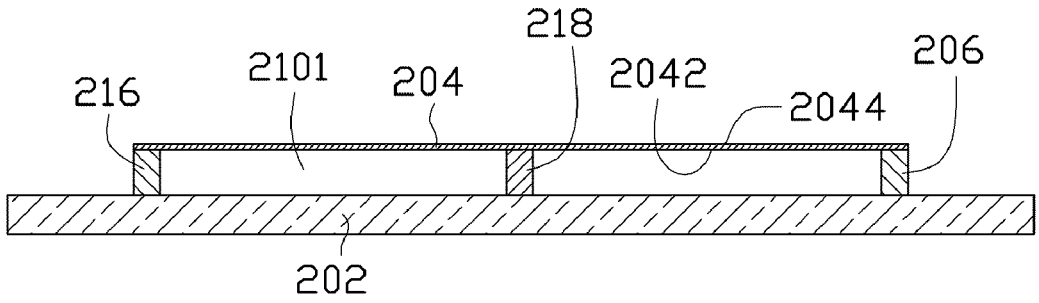
FIG. 15 is a cross-sectional view of one embodiment of a thermoacoustic module.
Figure 16:
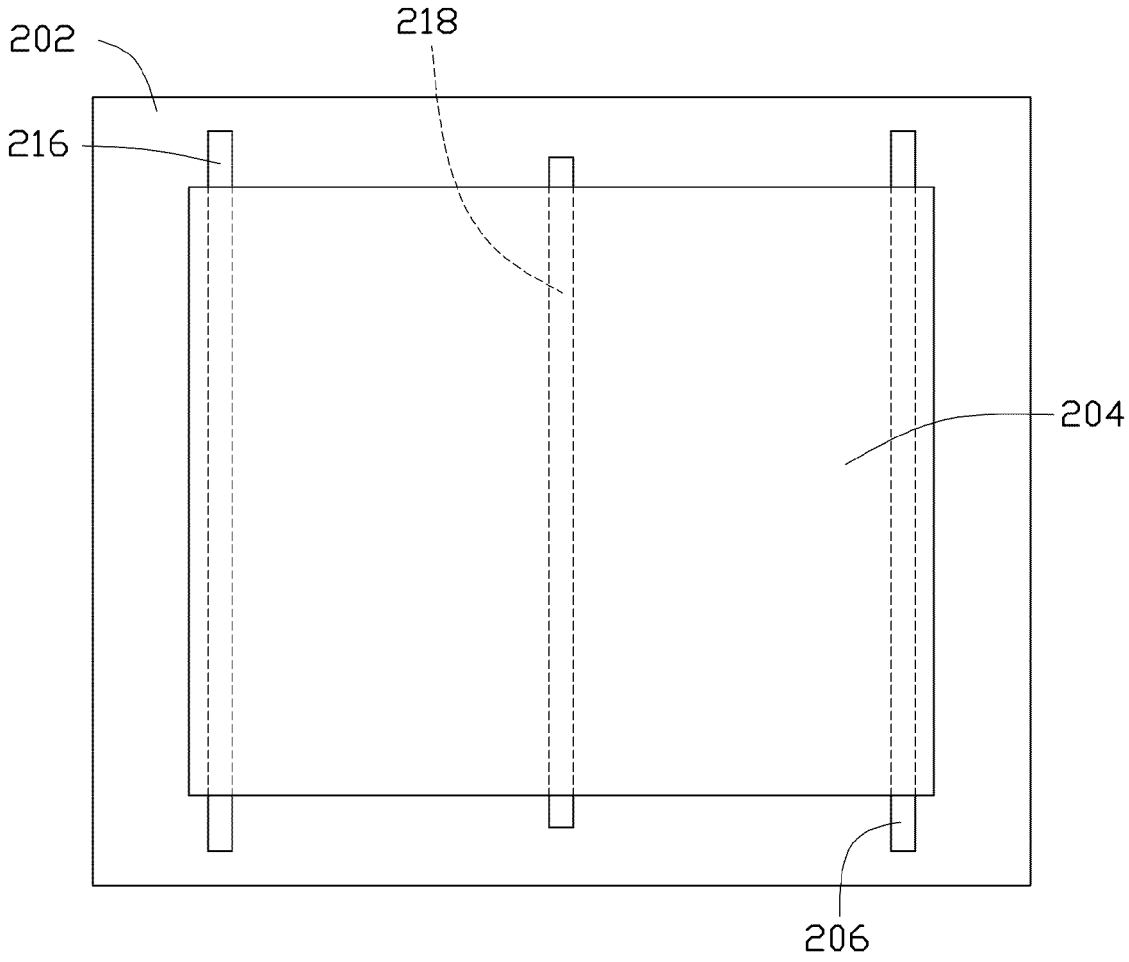
FIG. 16 is a schematic top plan view of the thermoacoustic module shown in FIG. 15.

Referring to FIGS. 15 and 16, in one embodiment, a thermoacoustic module includes a substrate 202, a first electrode 206, a second electrode 216, a spacer 218 and a sound wave generator 204.

The first electrode 206 and the second electrode 216 are located apart from each other on the substrate 202. The spacer 218 is located on the substrate 202 between the first electrode 206 and the second electrode 216. The sound wave generator 204 is located on and supported by the spacer 218 and spaced from the substrate 202. The sound wave generator 204 has a bottom surface 2042 and a top surface 2044 opposite to the bottom surface 2042. The spacer 218, the first electrode 206 and the second electrode 216 are located between the bottom surface 2042 and the substrate 202.

The electrodes 206, 216 can also provide structural support for the sound wave generator 204. A height of the first electrode 206 or the second electrode 216 can range from about 10 microns to about 1 centimeter.

In an embodiment, the first electrode 206 and the second electrode 216 are linear shaped silver paste layers. The linear shaped silver paste layers have a height of about 20 microns. The linear shaped silver paste layers are formed on the substrate 202 via a screen-printing method. The first electrode 206 and the second electrode 216 can be parallel with each other.

The spacer 218 is located on the substrate 202, between the first electrode 206 and the second electrode 216. The spacer 218, first electrode 206 and the second electrode 216 support the sound wave generator 204 and space the sound wave generator 204 from the substrate 202. An interval space 2101 is defined between the sound wave generator 204 and the substrate 202. Thus, the sound wave generator 204 can be sufficiently exposed to the surrounding medium and transmit heat into the surrounding medium.

The spacer 218 can be integrated with the substrate 202 or separate from the substrate 202. The spacer 218 can be attached to the substrate 202 via a binder. The shape of the spacer 218 is not limited and can be dot, lamellar, rod, wire, and block among other shapes. When the spacer 218 has a linear shape such as a rod or a wire, the spacer 218 can parallel to the electrodes 206, 216. To increase the contacting area of the carbon nanotube structure of the sound wave generator 204, the spacer 218 and the sound wave generator 204 can be line-contacts or point-contacts.

A material of the spacer 218 can be conductive materials such as metals, conductive adhesives, and indium tin oxides among other materials. The material of the spacer 218 can also be insulating materials such as glass, ceramic, or resin. A height of the spacer 218 substantially equal to or smaller than the height of the electrodes 206, 216. The height of the spacer 218 is in a range from about 10 microns to about 1 centimeter.

In some embodiments, the spacer 218 is a silver paste line being the same as the first electrode 206 and second electrode 216, formed via a screen-printing method at the same time. The spacer 218 can also be fixed on the substrate 202 by other means, such as by using a binder or a screw.

Additionally, the first and second electrodes 206, 216 can be formed at the same time as the spacers 218. In one embodiment, the spacer 218, the first electrode 206 and the second electrode 216 are parallel with each other, and have the same height of about 20 microns. The sound wave generator 204 can be planar and be supported by the spacer 218, the first electrode 206 and the second electrode 216 having the same height.

The sound wave generator 204 is located on the spacer 218, the first electrode 206 and the second electrode 216 and spaced apart from the substrate 202. The interval space 2101 is formed via the spacer 218, the sound wave generator 204, and the substrate 202, together with the first electrode 206 or the second electrode 216. The height of the interval space 2101 is determined by the height of the spacer 218 and first and second electrodes 206, 216. In order to prevent the sound wave generator 204 from generating standing wave, thereby maintaining good audio effects, the height of the interval space 2101 between the sound wave generator 204 and the substrate 202 can be in a range of about 10 microns to about 1 centimeter.

In one embodiment, the spacer 218, the first electrode 206 and the second electrode 216 have a height of about 20 microns, and the height of the interval space 2101 between the sound wave generator 204 and the substrate 202 is about 20 microns.

It is to be understood that, the carbon nanotube structure is flexible. When the distance between the first electrode 206 and the second electrode 216 is large, the middle region of the carbon nanotube structure between the first and second electrodes 206, 216 may sag and come into contact with the substrate 202. The spacer 218 can prevent the contact between the carbon nanotube structure and the substrate 202. Any combination of spacers 218 and electrodes 206, 216 can be used.

Figure 17:
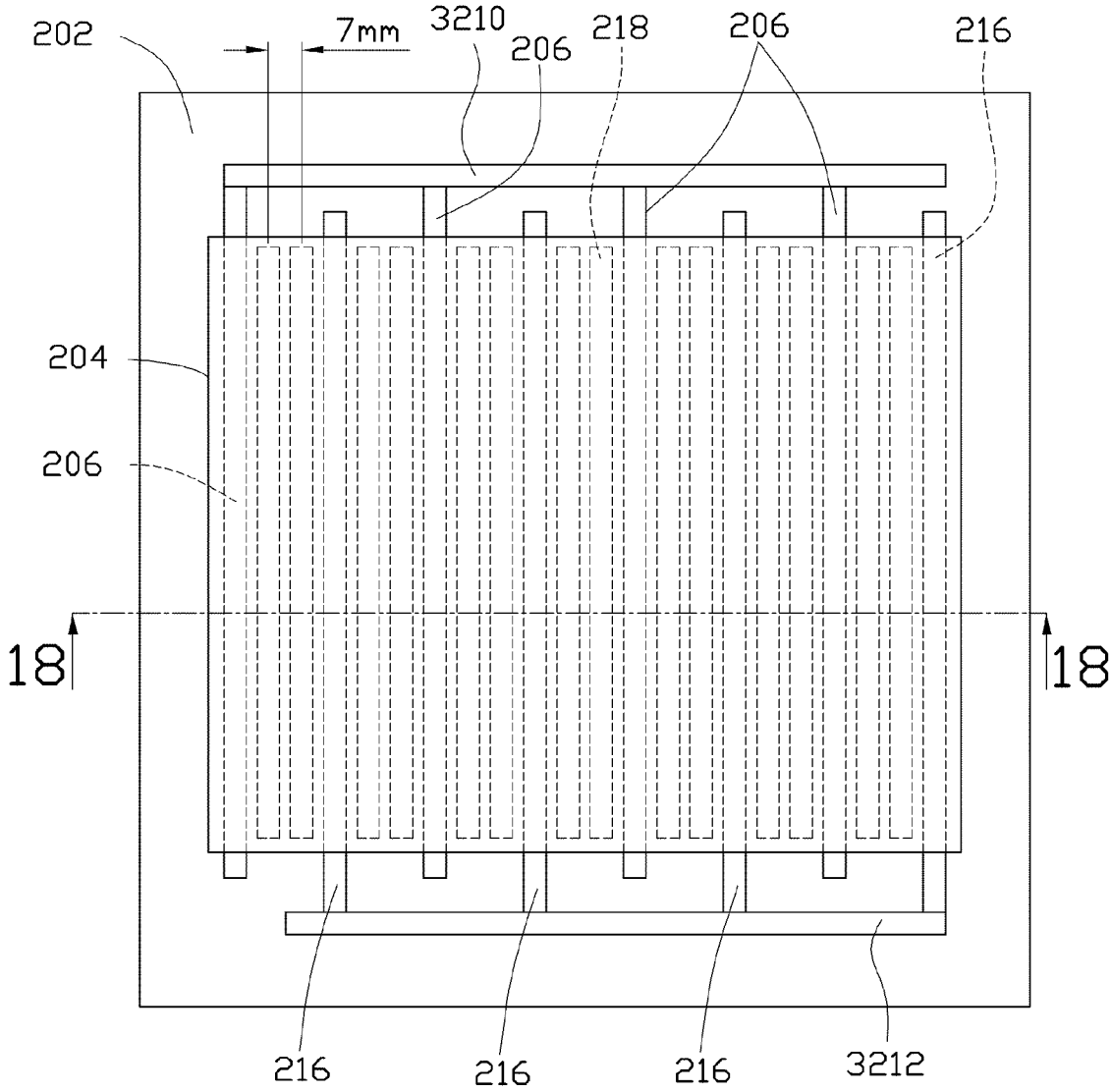
FIG. 17 is a schematic top plan view of one embodiment of a thermoacoustic module.
Figure 18:
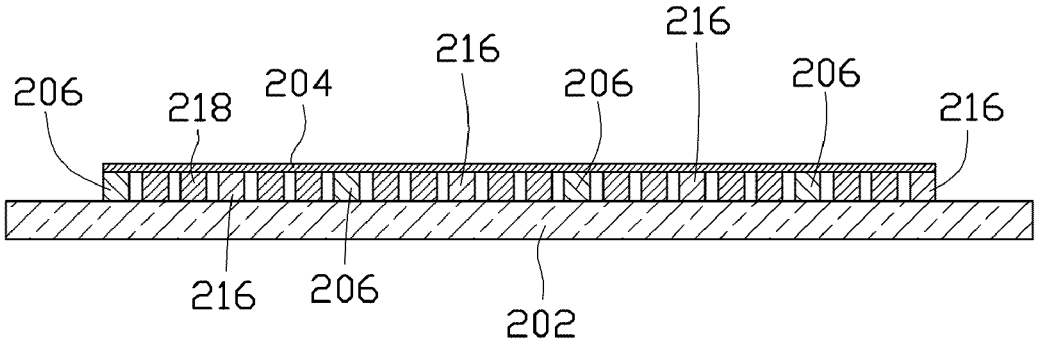
FIG. 18 is a cross-sectional view taken along a line 18-18 of the thermoacoustic module shown in FIG. 17.

Referring to FIGS. 17 and 18, in other embodiments, the thermoacoustic module includes a plurality of first electrodes 206, a plurality of second electrodes 216, and a plurality of spacers 218.

The first electrodes 206 and the second electrodes 216 are arranged on the substrate 202 as a staggered manner of +−+−. All the first electrodes 206 are connected to the first conducting member 3210. All the second electrodes 216 are connected to the second conducting member 3212. The first conducting member 3210 and the second conducting member 3212 can be silver paste lines like the first and second electrodes 206, 216, and are perpendicular to the first and second electrodes 206, 216. It is to be understood that the first and second conducting member 3210, 3212, the first and second electrodes 206, 216, and the spacers 218 can be formed on the substrate 202 at the same time by screen-printing a patterned silver paste lines on the top surface 230 of the substrate 202. The first conducting member 3210 and the second conducting member 3210 can be arranged on the substrate 202 and near the opposite edges of the substrate 202.

The spacers 218 can be located on the substrate 202 between every adjacent first electrode 206 and second electrode 216 and can be apart from each other for a same distance. A distance between every two adjacent spacers 218 can be in a range from 10 microns to about 3 centimeters.

In one embodiment, as shown in FIGS. 17 and 18, the thermoacoustic module includes four first electrodes 206, and four second electrodes 216. There are two spacers 218 between the adjacent first electrode 206 and the second electrode 216. The distance between the adjacent spacers 218 is about 7 millimeters, and the distance between the adjacent first electrode 206 and the second electrode 216 is about 2.1 centimeter.

Figure 19:
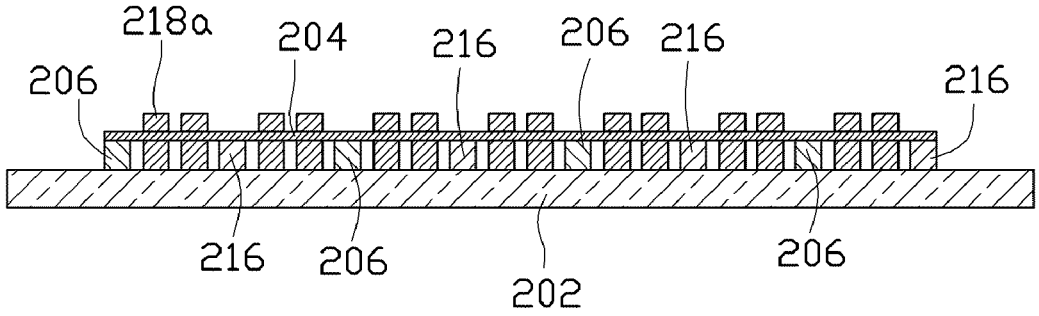
FIG. 19 is a cross-sectional view taken along a line of 19-19 of the thermoacoustic module shown in FIG. 48.
Figure 48:
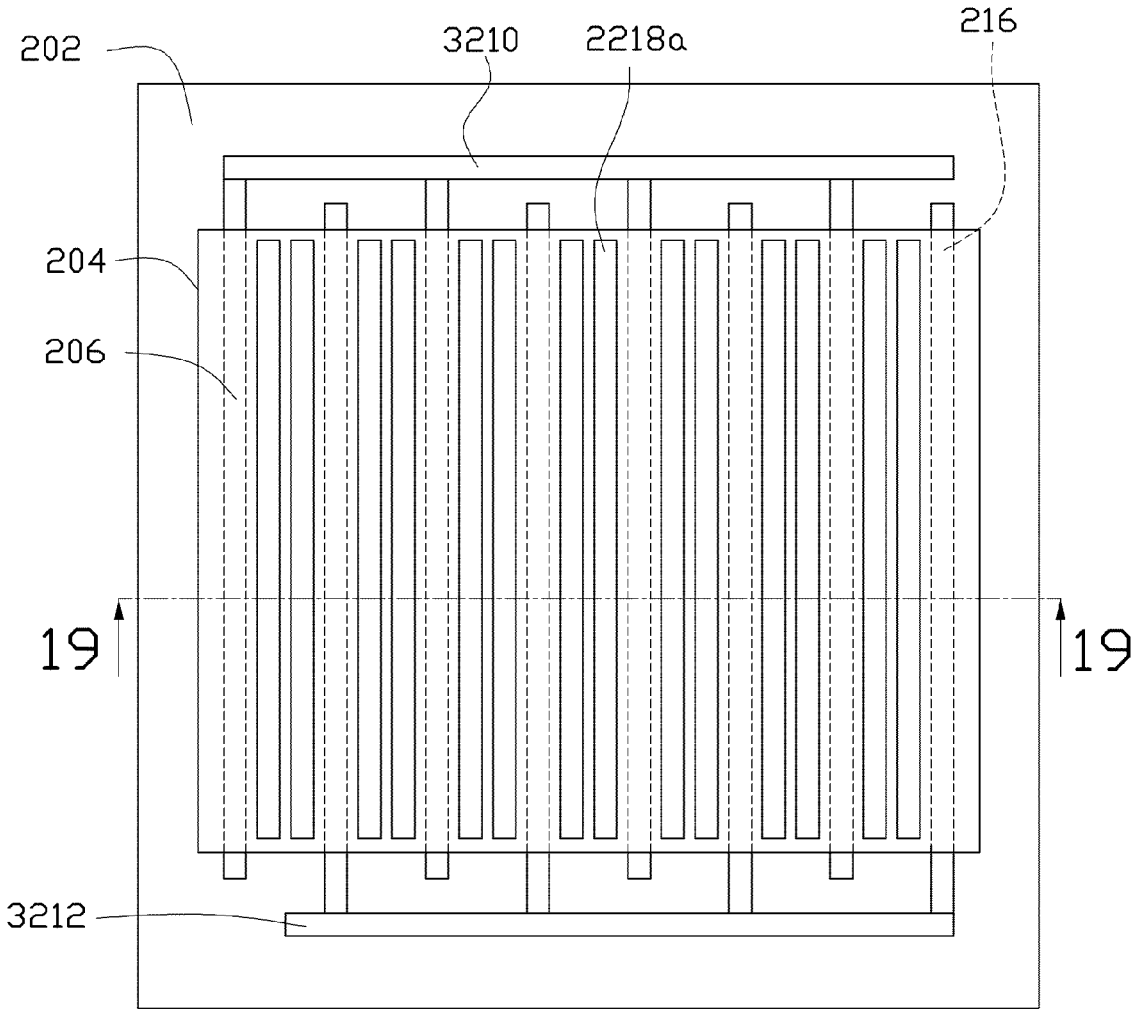
FIG. 48 is a schematic top plan view of one embodiment of a thermoacoustic module.

Referring to FIG. 19 and FIG. 48, alternatively, the sound wave generator 204 can be embedded in spacers 218*a* located between the adjacent the first electrode 206 and the second electrode 216, which means the spacers 218*a* extend above a top of the first and second electrodes 206, 216. Thus, the sound wave generator 204 can be securely fixed to the substrate 202. When the spacers 218*a* are made of silver paste screen-printed on the substrate 202, the sound wave generator 204 can be disposed on the silver paste lines before they are cured or solidified. The silver paste can infiltrate through the carbon nanotube structure and thereby extend above the sound wave generator 204.

Figure 20:
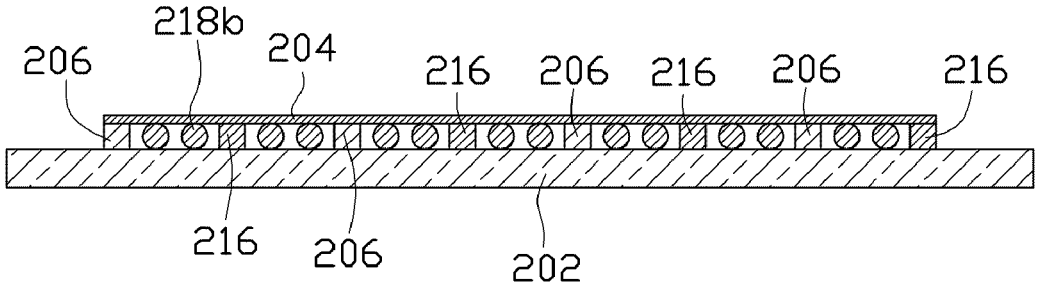
FIG. 20 is a cross-sectional view taken along a line 20-20 of the thermoacoustic module shown in FIG. 52.
Figure 52:
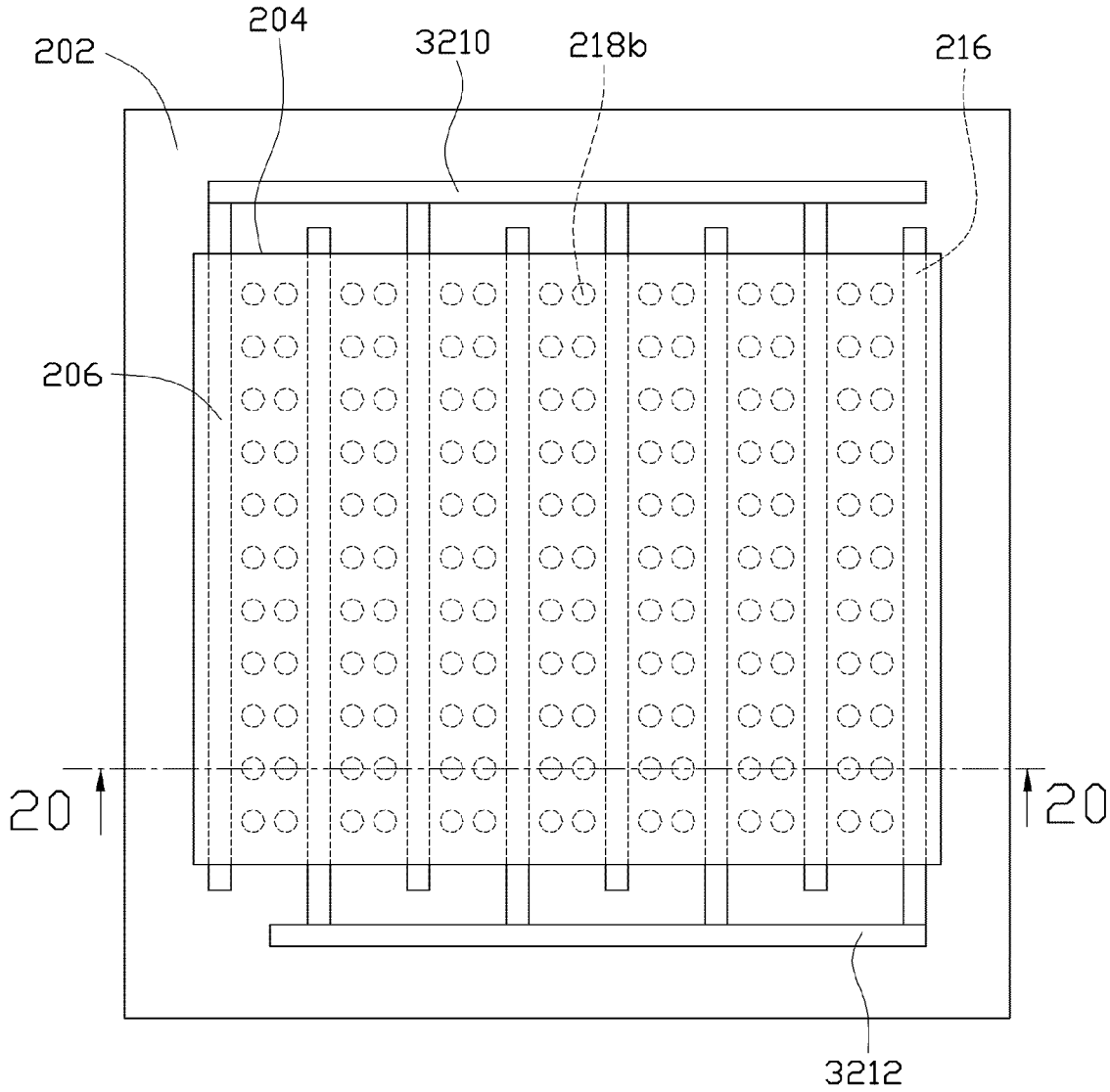
FIG. 52 is a schematic top plan view of one embodiment of a thermoacoustic module.

Referring to FIG. 20 and FIG. 52, alternatively, spacers can be sphere shaped (labeled as 218*b*). The sound wave generator 204 and the spacers 218*b* are in point-contacts. Therefore, the contacting area between the sound wave generator 204 and the spacers 218*b* is smaller, and the sound wave generator 204 has a larger contacting area with the surrounding medium. Thus, the efficiency of the thermoacoustic module can be increased.

The first electrodes 206 and the second electrodes 216 can also be supported by the spacers 218. The first electrodes 206 and the second electrodes 216 can be located on the top surface 2044 of the sound wave generator 204. The first and second electrodes 206, 216 can be positioned vertically above the spacers 218. Each of the first electrodes 206 or second electrodes 216 corresponds to one spacer 218. The sound wave generator 204 can be secured from the two sides thereof via the electrodes 206, 216 and the spacers 218.

Figure 21:
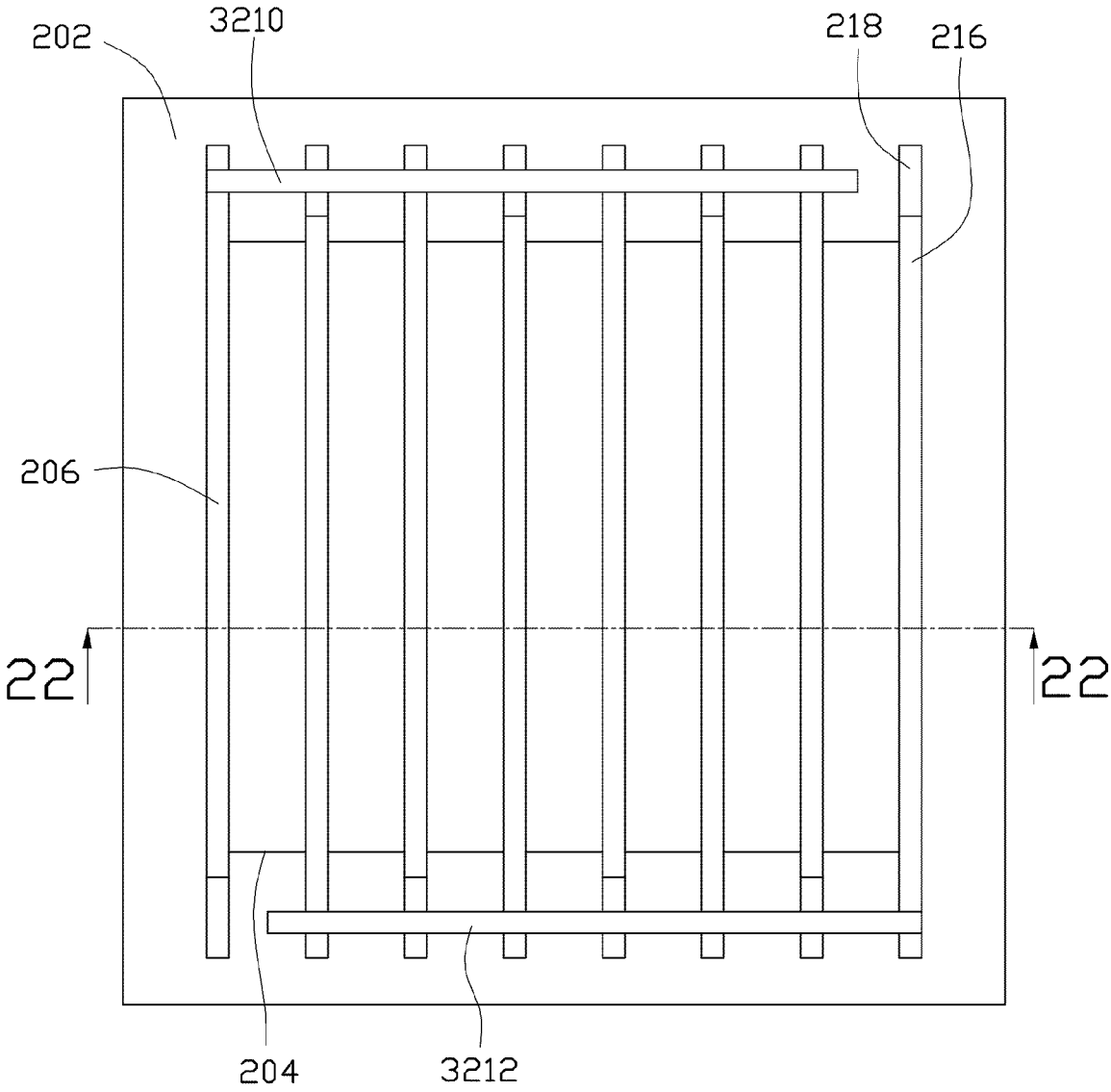
FIG. 21 is a schematic top plan view of one embodiment of a thermoacoustic module.
Figure 22:
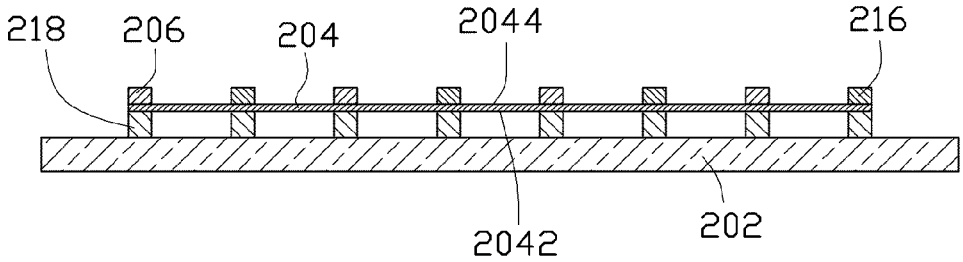
FIG. 22 is a cross-sectional view taken along a line 22-22 of the thermoacoustic module shown in FIG. 21.

In one embodiment as shown in FIGS. 21 and 22, the thermoacoustic module includes eight spacers 218, with a height of about 20 microns. The spacers 218 are formed on the substrate 202 via a screen-printing method. The sound wave generator 204 is located on the spacers 218 and adhered to the spacers 218 by a binder, and spaced from the substrate 202. Four first electrodes 206 and four second electrodes 216 can be located on the top surface 2044 via conductive binder. The first electrodes 206 and the second electrodes 216 can be wires made of stainless steel with a height of about 20 microns.

Figure 24:
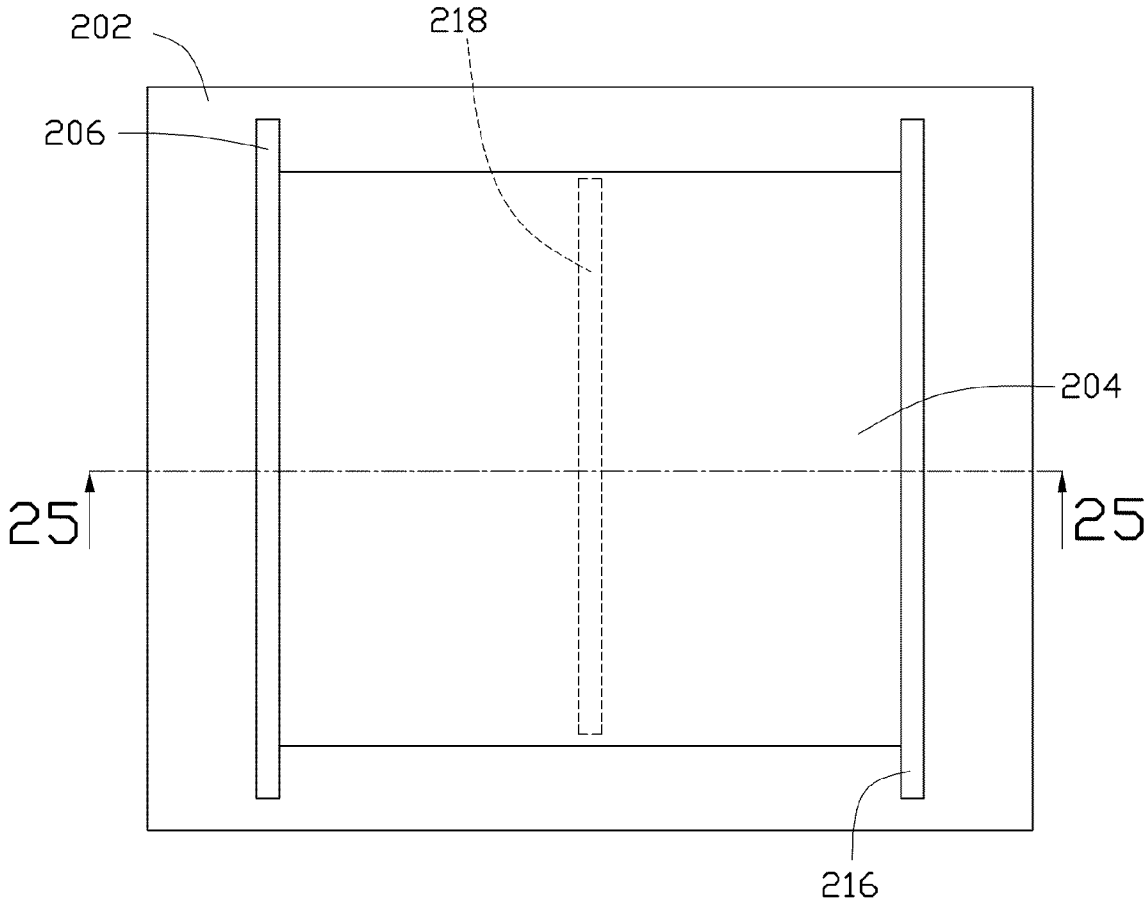
FIG. 24 is a schematic top plan view of one embodiment of a thermoacoustic module.
Figure 25:
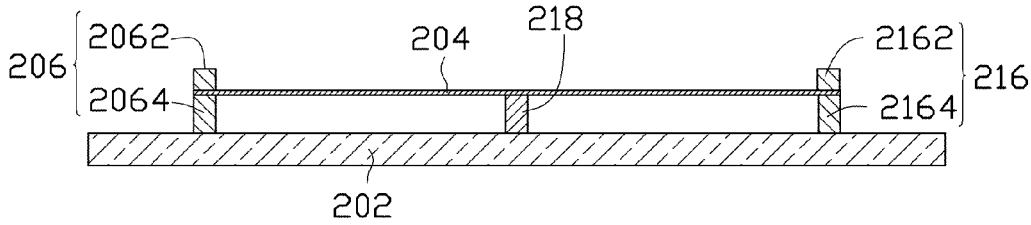
FIG. 25 is a cross-sectional view taken along a line 25-25 of the thermoacoustic module shown in FIG. 24.

Referring to FIGS. 24 and 25, in other embodiments, a thermoacoustic module includes a substrate 202, a first electrode 206, a second electrode 216, a spacer 218 and a sound wave generator 204. The sound wave generator 204 is separately embedded into the first electrode 206 and the second electrode 216, and the spacer 218 is located on the substrate 3102 between the first electrode 206 and the second electrode 216.

The first electrode 206 includes two portions, the upper portion 2062 is on a top surface 2044 of the sound wave generator 204, the lower portion 2064 is on a bottom surface 2042 of the sound wave generator 204, to secure the sound wave generator 204 from both sides. The second electrode 216 is similar to the first electrode 206, and includes the upper portion 2162 and the lower portion 2164.

A distance from the sound wave generator 204 to the substrate 202 can be in a range from about 10 microns to about 0.5 centimeters.

When the sound wave generator 204 is embedded into the first electrode 206 and the second electrode 216, the sound wave generator 204 will be very secured and electrically connected with the first and second electrodes 206, 216.

Figure 26:
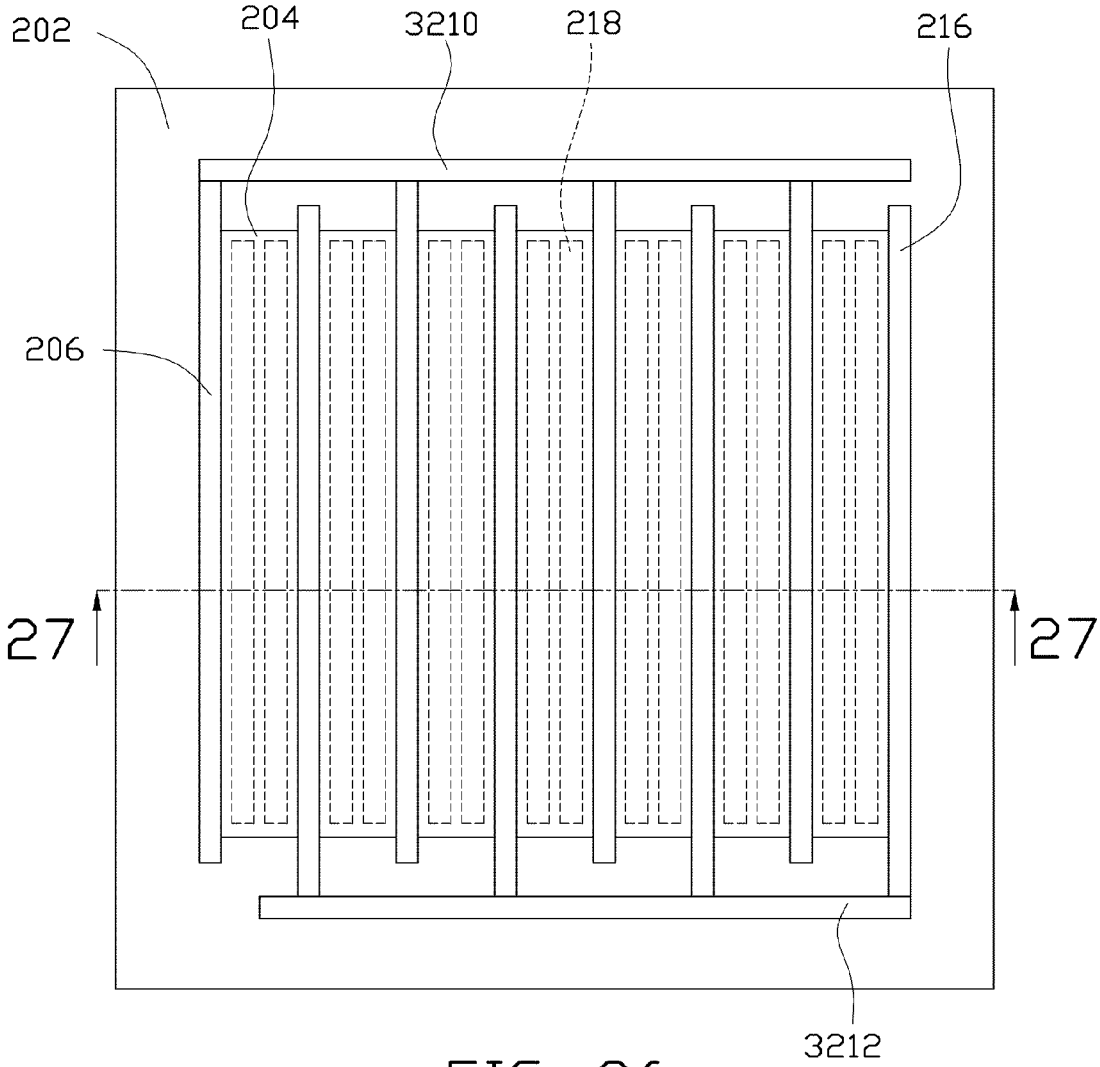
FIG. 26 is a schematic top plan view of one embodiment of a thermoacoustic module.
Figure 27:
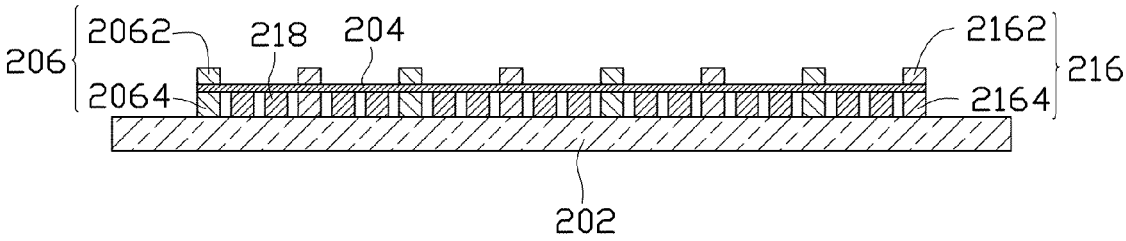
FIG. 27 is a cross-sectional view taken along a line 27-27 of the thermoacoustic module shown in FIG. 26.

Referring to FIGS. 26 and 27, in other embodiments, when there are a plurality of first electrodes 206 and second electrodes 216, the first electrodes 206 and the second electrodes 216 are located on the substrate 202 in an staggered manner (e.g. +−+−). The first electrodes 206 and the second electrodes 216 can be parallel to each other with a same distance between the adjacent first electrode 206 and the second electrode 216. The distance between the adjacent first electrode 206 and the second electrode 216 can be in a range from about 1 millimeter to about 2 centimeters. All the first electrodes 206 are electrically connected to the first conducting member 3210. All the second electrodes 216 are connected to the second conducting member 3212. The sections of the sound wave generator 204 between the adjacent first electrode 206 and the second electrode 216 are in parallel connection. An electrical signal is conducted in the sound wave generator 204 from the first electrodes 206 to the second electrodes 216.

The spacers 218 are located on the substrate 202 between every adjacent first electrode 206 and second electrode 216. The spacers 218 can be the same distance apart. The spacers 218, the first electrodes 206 and the second electrode 216 can be located on the substrate 202 with a same distance between each other and parallel with each other. A distance between every two adjacent spacers 218 can be in a range from 10 microns to about 1 centimeter.

In one embodiment shown in FIGS. 26 and 27, the thermoacoustic module includes four first electrodes 206, and four second electrodes 216. There are two spacers 218 between the adjacent first electrode 206 and the second electrode 216. The distance between the adjacent spacers 218 is about 2 millimeters. The distance between the adjacent first electrode 206 and the second electrode 216 is about 6 millimeters. The first electrode 206 includes the upper portion 2062 and the lower portion 2064. The second electrode 216 includes the upper portion 2162 and the lower portion 2164. The upper portions 2062, 2162 and the lower portions 2064, 2164 clamp the sound wave generator 204 therebetween.

Figure 28:
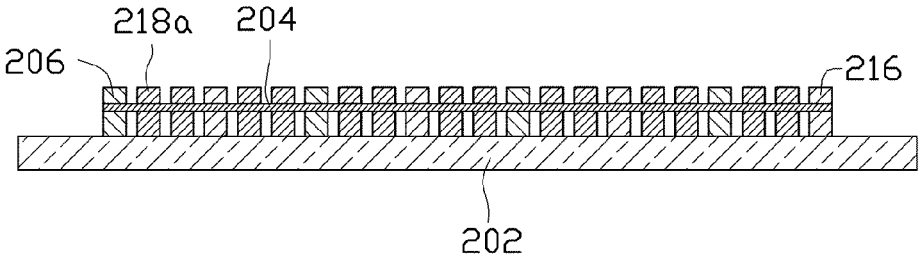
FIG. 28 is a cross-sectional view of one embodiment of a thermoacoustic module.

Referring to FIG. 28, the sound wave generator 204 can also be embedded in and clamped by the spacers 218*a*. More particularly, the spacers 218*a* can be conductive lines formed from conductive paste, like the electrodes 206, 216. Therefore, the electrodes 206, 216 and the spacers 218*a* can be screen printed on the substrate 202 at the same time.

Figure 29:
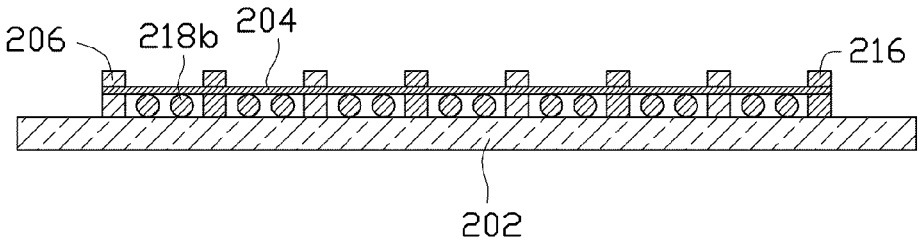
FIG. 29 is a cross-sectional view of one embodiment of a thermoacoustic module.

Referring to FIG. 29, the spacers 218*b* can be dot spacers 218*b* that have sphere shape while the sound wave generator 204 is embedded in and secured by the first and second electrodes 206, 216.

Screen-Printing Method for Making Thermoacoustic Module

Figure 30A:
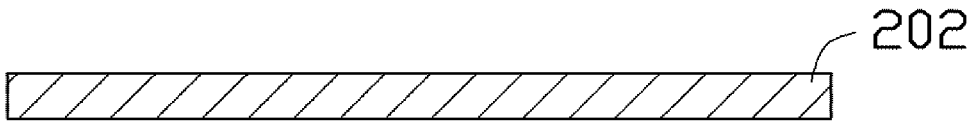
FIGS. 30A to 30C are cross-sectional views of one screen-printing embodiment for making a thermoacoustic module.
Figure 30B:
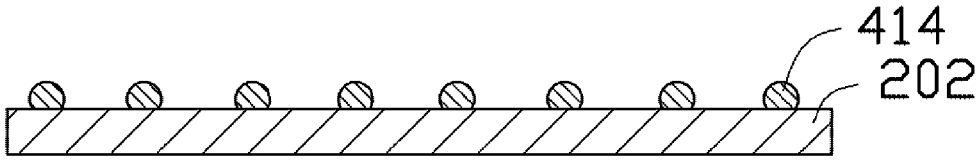
Figure 30C:
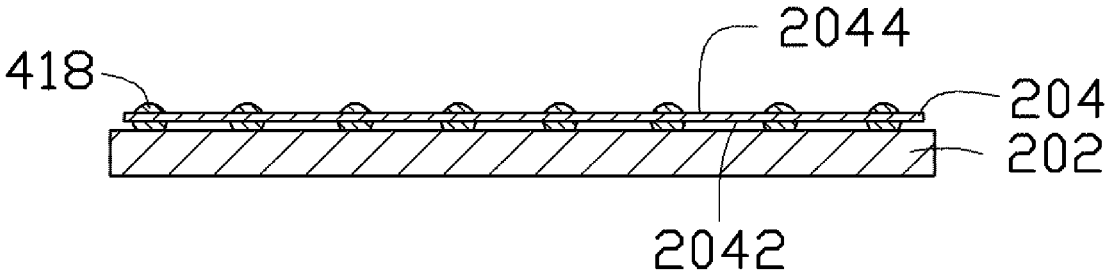
Figure 31A:
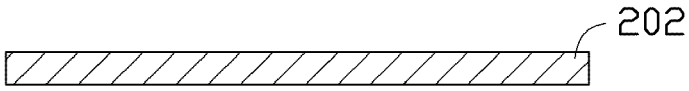
FIGS. 31A to 31D are cross-sectional views of one screen-printing embodiment for making a thermoacoustic module.
Figure 31B:
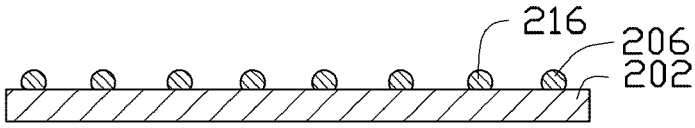
Figure 31C:
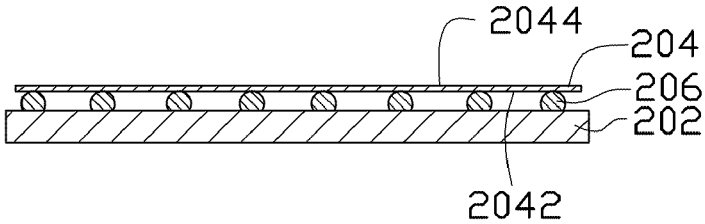
Figure 31D:
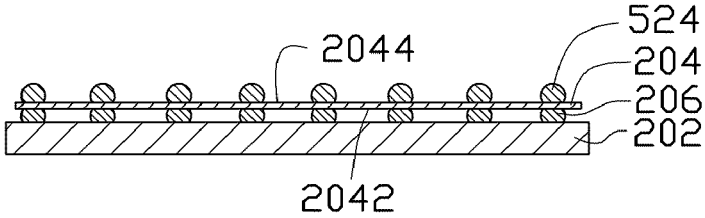

Referring to FIGS. 30A to 30C, the screen-printing method embodiment for making a thermoacoustic module includes:

S11: providing the insulating substrate 202 and the sound wave generator 204;

S12: screen printing a conductive paste on the top surface 230 of the insulating substrate 202 to form a patterned conductive paste layer 414;

S13: placing the sound wave generator 204 on the patterned conductive paste layer 414; and S14: solidifying the patterned conductive paste layer 414 to form at least the first and second electrodes 206, 216.

The step S12 includes the following substeps of:

S121: covering a patterned screen-printing plate on the top surface 230 of the insulating substrate 202, wherein the patterned screen-printing plate defines patterned openings;

S122: applying the conductive paste through the patterned openings to the top surface 230 of insulating substrate 202;

S123: removing the patterned screen-printing plate from the insulating substrate 202.

In step S121, the patterned openings correspond to the patterned conductive paste layer 414 located on the top surface 230 of the insulating substrate 202. The patterned openings can be designed according to the shapes and positions of the first and second electrodes 206, 216 and/or spacers 218 and/or the first and second conducting members 3210, 3212 that needed to be formed on the insulating substrate 202. The first and second electrodes 206, 216, the spacers 218, and the first and second conducting members 3210, 3212 can be screen printed on the substrate 202 at the same time or not. In one embodiment, the patterned screen-printing plate includes eight rectangle openings. The rectangle openings are parallel with each other. Each rectangle opening has a width of 150 microns and a length of 16 centimeters. A distance between every two adjacent rectangle openings is 2 centimeters.

Step S122 includes the following substeps of:

S1221: applying a conductive paste on the patterned screen-printing plate; and S1222: forcing the conductive paste into the openings.

The conductive paste may include metal powder, glass powder, and binder. In one embodiment, the conductive paste includes 50% to 90% (by weight) of the metal powder, 2% to 10% (by weight) of the glass powder, and 10% to 40% (by weight) of the binder. The metal powder can be silver powder, gold powder, copper powder, or aluminum powder. The binder can be terpineol or ethyl cellulose (EC). The conductive paste has a desired degree of viscosity for screen-printing.

In step S123, the patterned conductive paste layer 414 is formed on the top surface 230 of the insulating substrate 202. The patterned conductive paste layer 414 includes a plurality strips or lines. A shape of the strip corresponds to the shape of the opening. In one embodiment, the patterned conductive layer 414 includes eight strips of conductive paste, and each strip of conductive paste has a height in a range from about 5 microns to about 100 microns.

In step S13, the sound wave generator 204 is free-standing, and can be laid on the patterned conductive paste layer 414 before the patterned conductive paste layer 414 is cured into solid. However, when the first and second conducting member 3210, 3212 are screen printed on the substrate 202 together with the electrodes 206, 216, and/or the spacers 218, the first and second conducting member 3210, 3212 is not covered by the sound wave generator 204.

The conductive paste can have a viscosity that allows it to infiltrate into the sound wave generator 204. That is to say, the conductive paste has a suitable viscosity to allow the sound wave generator 204 embedded into the patterned conductive paste layer 414 under action of the gravity or other outer forces. More specifically, the conductive paste can infiltrate in the interspaces defined by the carbon nanotubes in the carbon nanotube structure. In another aspect, the conductive paste can have viscosity and can prevent the sound wave generator 204 from passing through the patterned conductive paste layer 414 to reach the top surface 230 of the substrate 202 before the conductive paste is cured. The viscosity of the conductive paste is not too high and not too low, and thus, the sound wave generator 204 can be embodied into the patterned conductive paste layer 414 and suspended from the insulating substrate 202. In one embodiment, the patterned conductive paste layer 414 is made of the conductive paste in a colloidal state.

It is to be understood that, for the reason that the sound wave generator 204 is flexible, and when it is embedded in the patterned conductive paste layer 414, the portion of the sound wave generator 204 between two strips or lines of the patterned conductive paste layer 414 may be curved under the action of gravity, and come into contact with the top surface of the substrate 202. Therefore, the number of the patterned conductive paste layer 414 should be enough to enable at least above 90% of the area of the sound wave generator 204 is not in contact with the top surface 230 of the substrate 202 and is suspended.

Furthermore, step S13 can further include pressing the sound wave generator 204 placed on the patterned conductive paste layer 414 by an additional force. The additional force can be applied by air flow. The step of pressing the sound wave generator 204 can includes: providing a blower; blowing the top surface 2044 of the sound wave generator 204 via the blower to cause the conductive paste to infiltrate the sound wave generator 204. The blowing method can prevent damage to the sound wave generator 204. The conductive paste can exposed from the top surface 2044 of the sound wave generator 204.

In step S14, the patterned conductive paste layer 414 can be solidified by different methods (e.g., drying, heating, or UV curing) according to different material of the conductive paste. In one embodiment, the patterned conductive paste layer 414 includes the terpineol or ethyl cellulose (EC) and can be heated in a heating device. The solidified patterned conductive paste layer 414 becomes the plurality of first and second electrodes 206, 216 and/or spacers 218 and/or the first and second conducting members 3210, 3212 on the insulating substrate 202. The sound wave generator 204 can be embedded in the first and second electrodes 206, 216 and/or the spacers 218 and suspended from the insulating substrate 412. However, the sound wave generator 204 does not cover or embedded in the first and second conducting members 3210, 3212. In one embodiment, four first electrodes 206 and four second electrode 216 are formed on the insulating substrate 202, and each electrode 206, 216 has a width of about 150 microns and a length of about 16 centimeters. A distance between the adjacent first and second electrodes 206, 216 is about 2 centimeters, and each of the electrode 206, 216 has a height in a range from about 5 microns to about 100 microns. Further, due to the suspension from the substrate 202, the sound wave generator 204 can be sufficiently contacted with the surrounding medium, therefore the efficiency of the thermoacoustic module can be increased.

Bonding Layders

Figure 32:
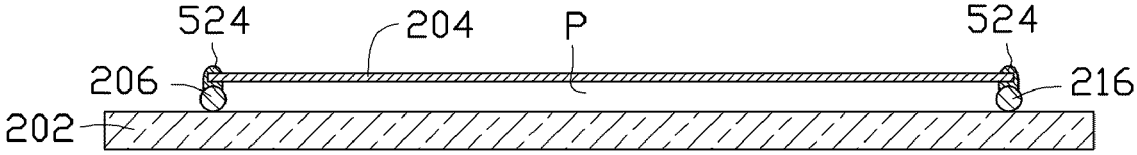
FIG. 32 is a cross-sectional view of one embodiment of a thermoacoustic module.

Referring to FIG. 32, the thermoacoustic module can further include conductive bonding layers 524 to secure the sound wave generator 204 on the first and second electrodes 206, 216 and/or the spacers 218. The conductive bonding layers 524 can be separately located on the first electrode 206 and/or the second electrode 216 and/or the spacers 218. The sound wave generator 204 is embedded in the conductive bonding layers 524, and supported by the first electrode 206 and the second electrode 216. The conductive bonding layers 524 fix the sound wave generator 204 on the first electrode 206 and the second electrode 216. The conductive bonding layers 524 can infiltrate into the sound wave generator 204 and may come into contact with the electrodes 206, 216. The sound wave generator 204 is electrically connected to the first electrode 206 and the second electrode 216 via the conductive bonding layers 524.

The conductive bonding layers 524 can be used to provide electrical contact and connection between the first and second electrodes 206 216 and the sound wave generator 204. In one embodiment, the conductive bonding layer 524 is a layer of silver paste. A material of the conductive bonding layers 524 can be a conductive paste and/or a conductive adhesive. The conductive paste or the conductive adhesive can comprise of metal particles, binder and solvent. The metal particles can be gold particles, silver particles, copper particles, or aluminum particles. In one embodiment, the conductive bonding layer 524 is a layer of silver paste.

The silver paste can be coated on the surface of the first electrode 206 and the second electrode 216 to form the two conductive bonding layers 524. The sound wave generator 204 can be placed on the two conductive bonding layers 524 before the silver paste being solidified. The sound wave generator 204 can comprise of a carbon nanotube structure with a plurality of interspaces between the adjacent carbon nanotubes. The silver paste can have a desired viscosity before being solidified. Thus, the silver paste can filled into the interspaces of the carbon nanotube structure. After being solidified, the silver paste is formed into the conductive bonding layers 524, therefore the sound wave generator 204 is partly embedded into the conductive bonding layers 524.

In one embodiment, the first electrode 206 and the second electrode 216 are rod-shaped metal electrodes such as metal wires, parallel with each other, and located on the top surface 230 of the substrate 202. An interval space P is defined between the first electrode 206, the second electrode 216, the sound wave generator 204 and the substrate 202. Further, in order to prevent the sound wave generator 204 from generating standing wave, and maintain good audio effects, a distance between the sound wave generator 204 and the substrate 202 can be in a range from about 10 microns to about 1 centimeter.

Figure 33:
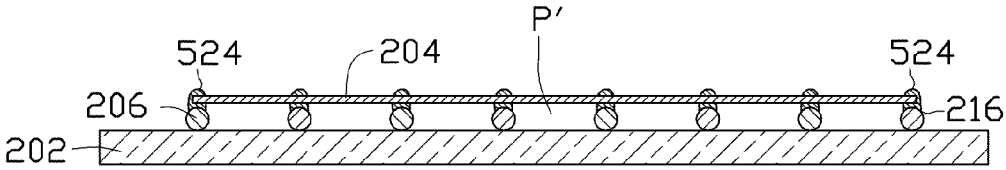
FIG. 33 is a cross-sectional view of one embodiment of a thermoacoustic module.
Figure 34:
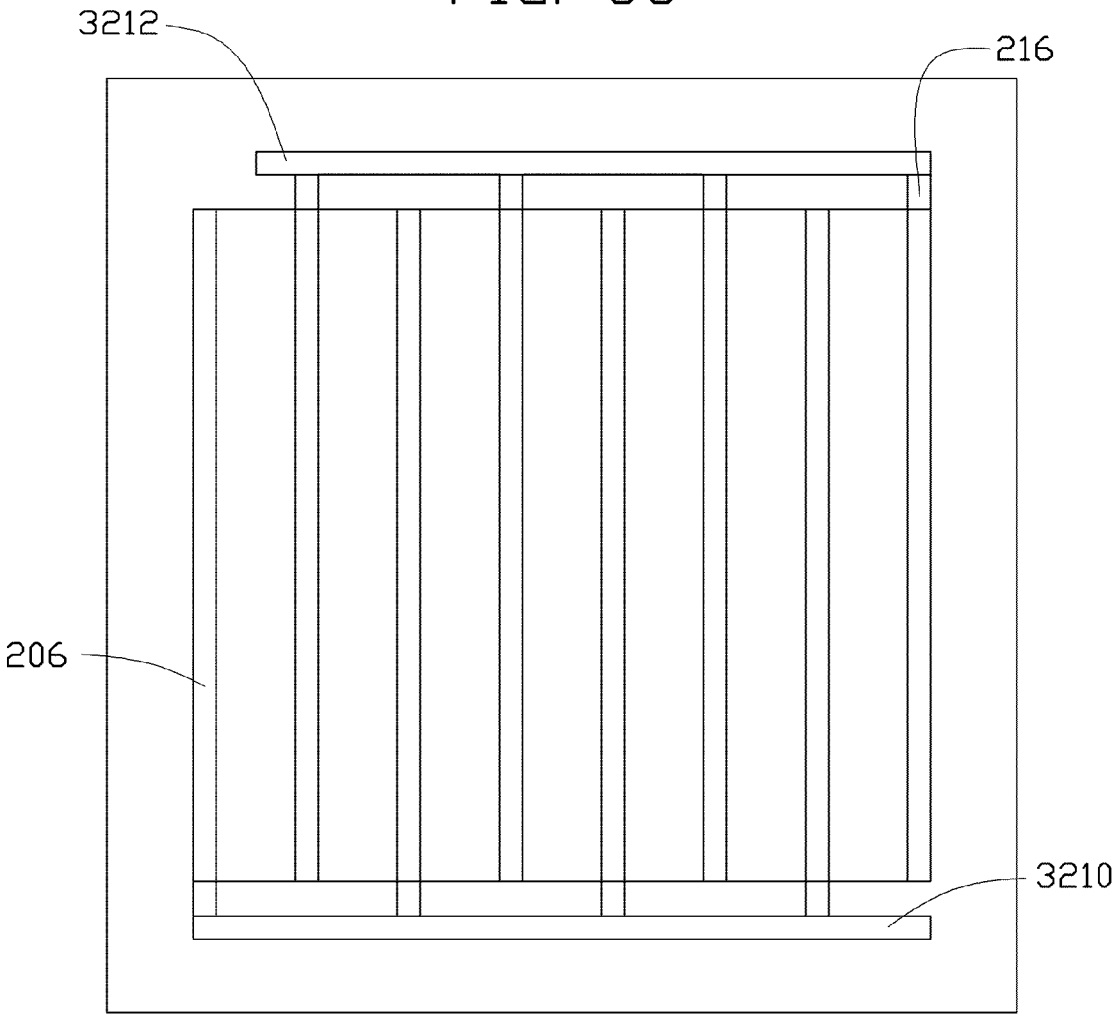
FIG. 34 is a schematic top plan view of the thermoacoustic module show in FIG. 33.

Referring to FIGS. 33 and 34, when the thermoacoustic module include a plurality of first electrodes 206, and second electrodes 216, the conductive bonding layers 524 can be arranged on each of the electrodes 206, 216. A plurality of interval spaces P' can be defined between the first electrode 206, the second electrode 216, the sound wave generator 204 and the substrate 202.

Furthermore, the first electrodes 206 and the second electrodes 216 are alternately and staggered arranged (e.g. +−+−). The first electrodes 206 and the second electrodes 216 can be substantially parallel to each other with a same distance between the adjacent first electrode 206 and the second electrode 216 All the first electrodes 206 are connected to a first conducting member 3210. All the second electrodes 216 are connected to a second conducting member 3212. However, the sound wave generator 204 is not located above the first and second conducting member 3210, 3212.

In one embodiment, the thermoacoustic module includes four first electrodes 206, four second electrodes 216, and eight conductive bonding layers 524. One conductive bonding layer 524 is located on each one of the first electrodes 206 and the second electrodes 216. The distance between the adjacent first electrode 206 and the second electrode 216 is about 1.7 centimeters.

Figure 35:
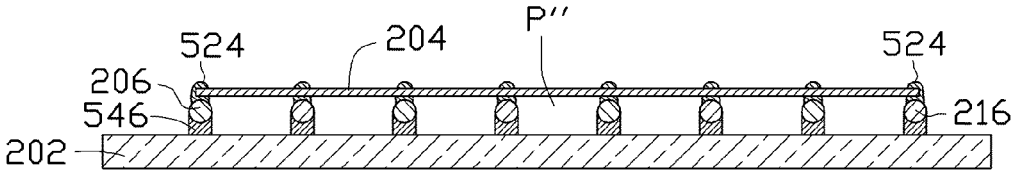
FIG. 35 is a cross-sectional view of one embodiment of a thermoacoustic module.

Referring to FIG. 35, a thermoacoustic module includes a plurality of holders 546. A plurality of interval spaces P" is defined between the first electrode 206, the second electrode 216, the sound wave generator 204, the holders 546 and the substrate 202. The holders 546 are located on the substrate 202 parallel with each other, and spaced from each other for a distance. One of first electrodes 206 and second electrode 216 is located on each one of the holders 546. There is the holders 546 between each of the first electrodes 206 and the second electrodes 524 and the substrate. A material of the holders 546 can be conductive materials such as metals, conductive adhesives, and indium tin oxides among other materials. The material of the holders 546 can also be insulating materials such as glass, ceramic, or resin. In one embodiment, the holders 546 are made of glass. The spacers 546 are arranged to elevate the first and second electrodes 206, 216 thereon, thereby increasing the height of the interval spaces P" between the sound wave generator 204 and the substrate 202.

Screen-Printing Method for Making Thermoacoustic Module Including Bonding Later

Referring to FIGS. 31A to 31D, an embodiment for screen-printing a thermoacoustic module includes the following steps of:

S21: providing an insulating substrate 202 and a sound wave generator 204;

S22: screen printing a conductive paste to a surface of the insulating substrate 202 to form a first patterned conductive paste layer, and solidifying the first patterned conductive paste layer to form at least the plurality of electrodes 206, 216;

S23: placing the sound wave generator 204 on the plurality of electrodes 206, 216, and screen printing the conductive paste on the sound wave generator 204 to form a second patterned conductive paste layer corresponding to the electrodes 206, 216; and S24: solidifying the second patterned conductive paste layer.

In step 22 the first patterned conductive paste layer is solidified into at least the first and second electrodes 206, 216 before the sound wave generator 204 is placed thereon. After placing the sound wave generator 204, the additional conductive paste is applied on the top surface 2044 of the sound wave generator 204 to form the second patterned conductive paste layer at the position above the first and second electrodes 206, 216. The second patterned conductive paste layer includes a plurality of strips or lines which corresponding to the first and second electrodes 206, 216. The conductive paste can infiltrate into the sound wave generator 204 and coat the electrodes 206, 216. In step S24, the second patterned conductive paste layer is solidified to be a plurality of bonding layers 524.

It is to be understood that, the spacers 218 can also be formed on the substrate 202 at the same time as the electrodes 206, 216. The second patterned conductive paste layer can be screen printed not only at the positions above the electrodes 206, 216, but also at the positions above the spacers 218.

Cover Board

The thermoacoustic module 612 can further include a cover board 610 to cover the sound wave generator 204 thereby protecting the sound wave generator 204 from being damaged. The cover board 610 can have the same shape, structure, and material as that of the substrate 202. In one embodiment, the cover board 610 is made of glass. The cover board 610 can be located on and supported by two supporters 614. The cover board 610 can be in partial contact with the sound wave generator 204 or spaced from the sound wave generator 204.

Figure 36:
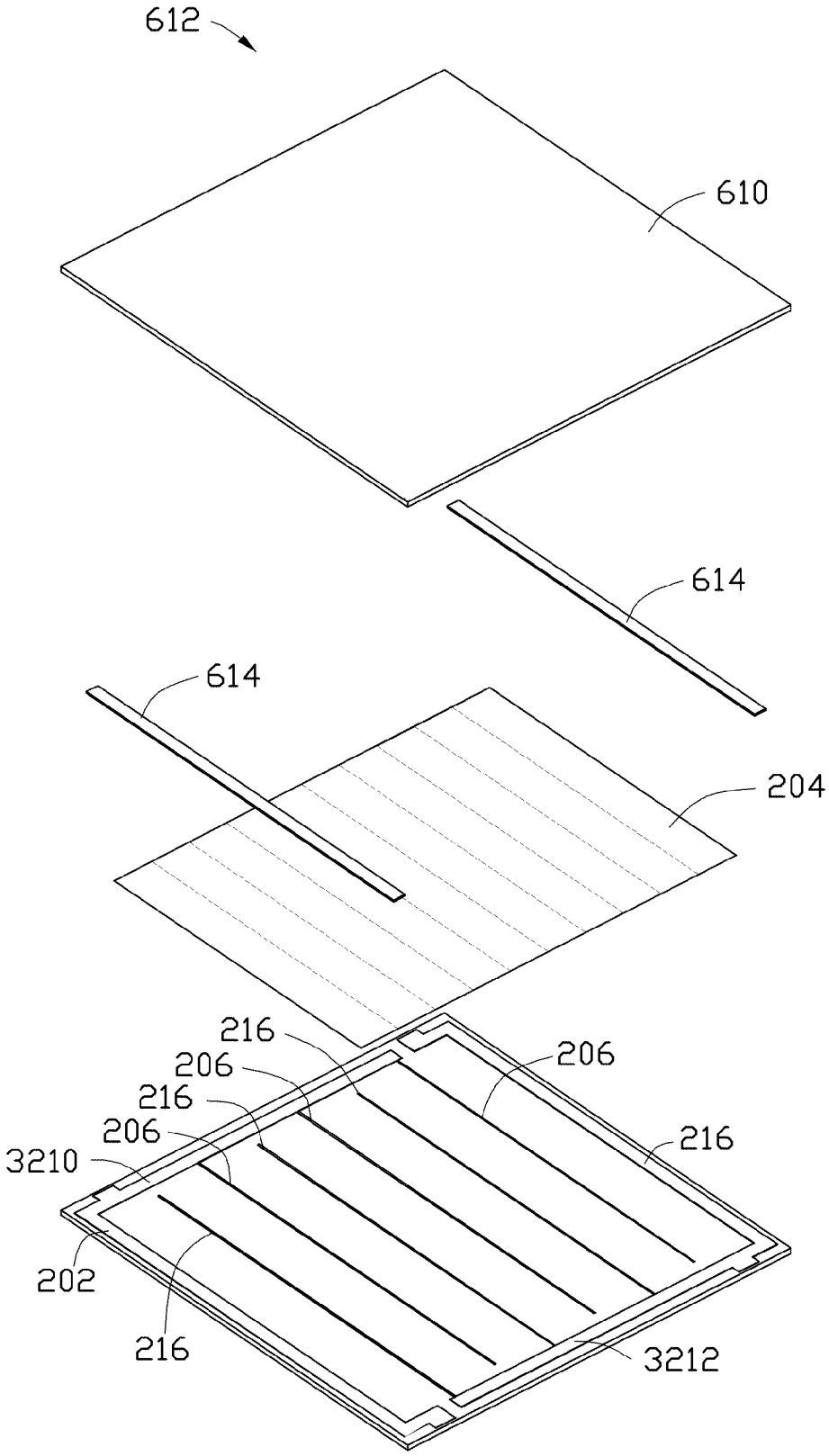
FIG. 36 is an exploded view of one embodiment of a thermoacoustic module.

Referring to the embodiment shown in FIG. 36, the sound wave generator 204 is located on and supported by the first electrodes 206 and the second electrodes 216. The cover board 610 is spaced from the substrate 202. Supporters 614 are located between the cover board 610 and the substrate 202 to separate the cover board 610 from the substrate 202. The sound wave generator 204, first electrodes 206 and second electrodes 216 are located between the substrate 202 and the cover board 610.

The two supporters 614 can be insulating strips and parallel with the first electrodes 206 or the second electrodes 216. The two supporters 614 are located separately at the two edges of a top surface of the substrate 202. The two supporters 614 are used for supporting the cover board 610. A height of the supporters 614 is greater than the height of the first electrodes 206 and the second electrodes 216. The two supporters 614 can be made of insulating materials, such as glass, ceramic, or resin. In one embodiment, the two supporters 614 are made of polytetrafluoroethylene (PTFE). The cover board 610 is located on and supported by the two supporters 614.

It is to be understood that, a plurality of spacers can be located between the sound wave generator 204 and the substrate 202.

Frame

Figure 37:
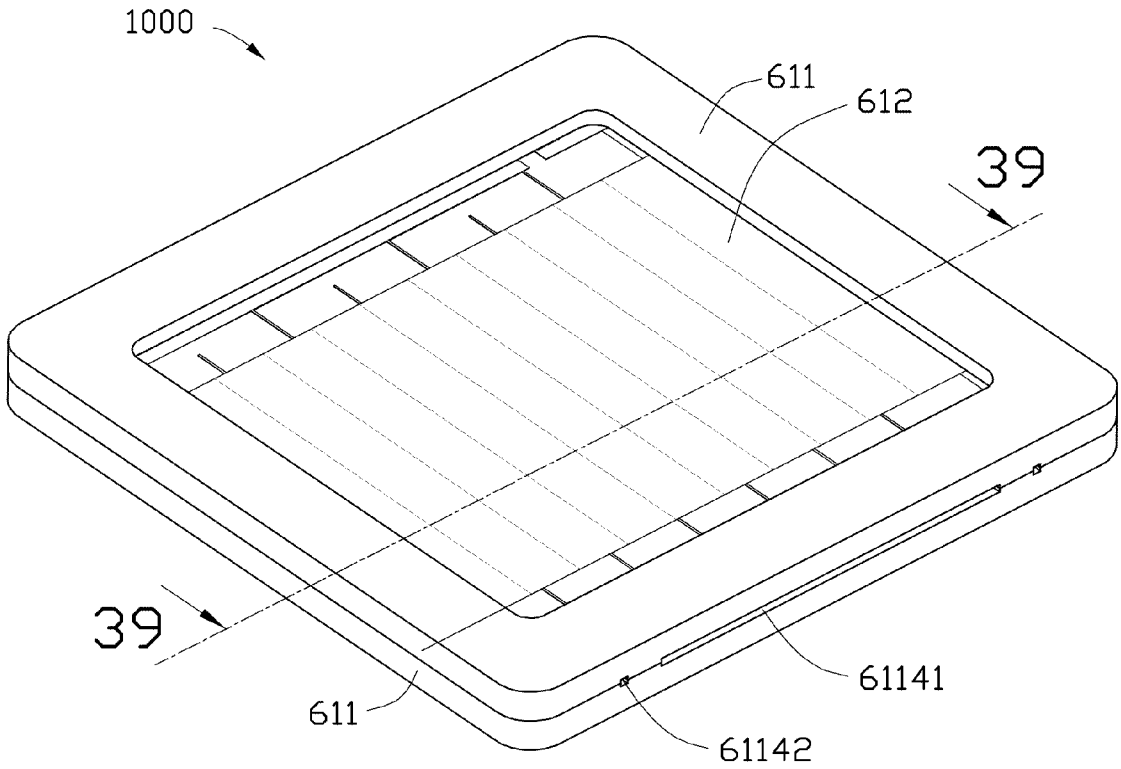
FIG. 37 is a schematic view of one embodiment of a thermoacoustic device.

Referring FIG. 37, the thermoacoustic device 1000 can further include two fixing frames 611 to secure the thermoacoustic module. The thermoacoustic module 612 can be fixed between the two fixing frames 611. The two fixing frames 611 can cooperate with each other to fasten the thermoacoustic module 612 therebetween. The two fixing frames 611 can be fixed with each other by bolts, riveting, buckle, scarf, adhesive or any other connection means.

Figure 38:
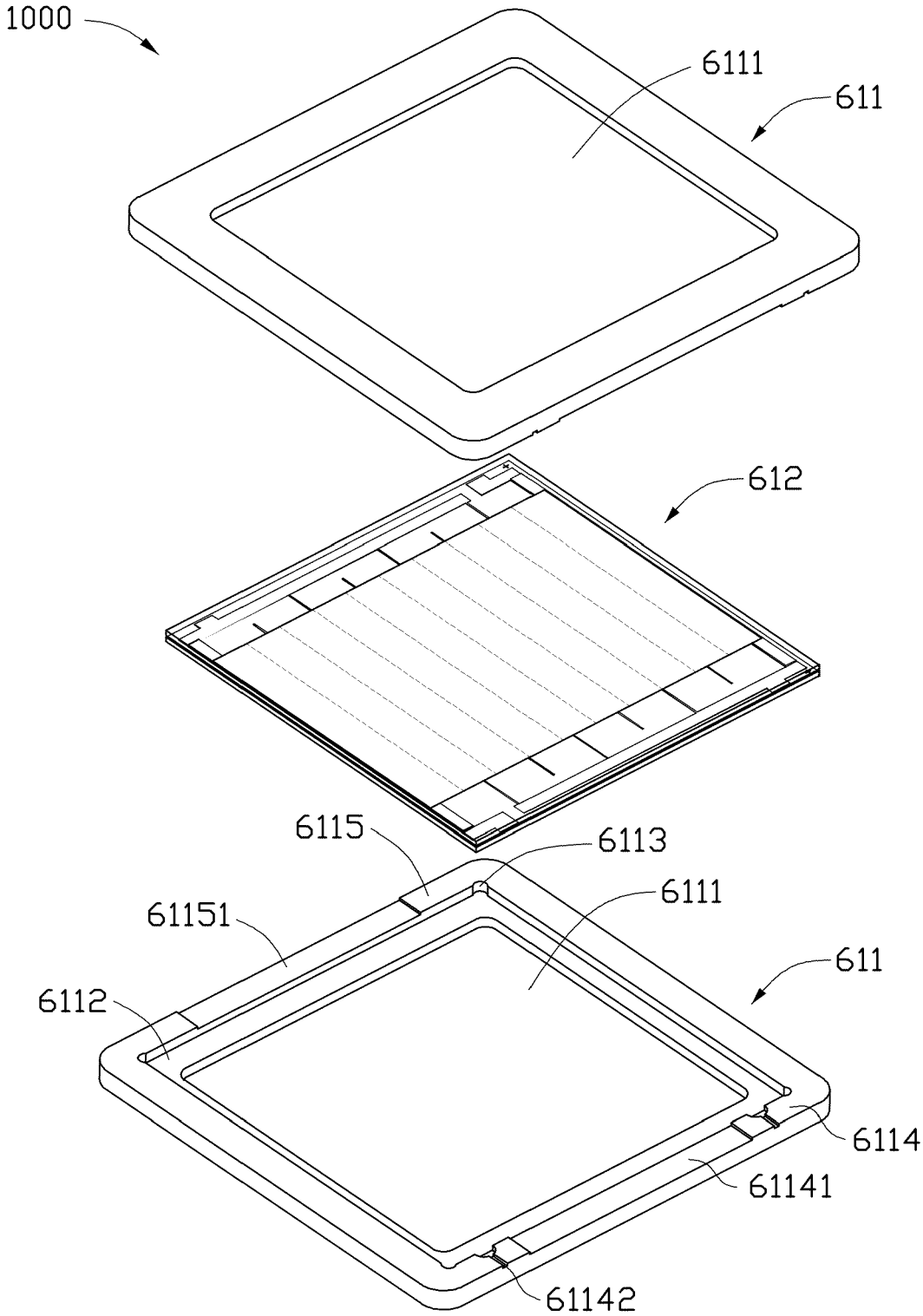
FIG. 38 is an exploded view of the thermoacoustic device shown in FIG. 37.

Referring to FIGS. 37 and 38, the two fixing frames 611 can have the same structure, and can have a rectangular shape. In one embodiment, the fixing frame 611 includes four frame members joined end to end to define a rectangle opening 6111. Each frame member has a recess formed along the side adjacent to the opening 6111. The recess can have a stepped configuration. The recesses of the four frame members connect together to define an engaging portion 6112. The engaging portion 6112 is to accommodate and hold the thermoacoustic module 612. A depression 6113 is defined between two adjacent frame members at the corner where the two frame members joined together. Two of the four frame members which are opposite to each other are labeled as 6114 and 6115. The top surface of the frame members 6114 and 6115 facing to the thermoacoustic module 612 can define two heat dissipating grooves 61141, 61151. The heat dissipating grooves 61141, 61151 are used for dissipating the heat produced by the thermoacoustic module 612. Two lead wire channels 61142 are located apart on the top surface of the frame members 6114 at the two sides of the heat dissipating grooves 61141. The lead wire channels 61142 can allow the lead wires go therethrough, thereby connecting the thermoacoustic module 612 to a signal device. It is to be understood that the fixing frames 611 can have other shapes besides the rectangular shape shown in FIG. 37. The shape of the fixing frames 611 can vary according to the shape of the thermoacoustic module. For example, when the thermoacoustic module has a round plate shape, the fixing frames 611 can also have an annular shape accordingly. Additionally, the shape of the thermoacoustic module and the fixing frames 611 need not be similar.

Figure 39:
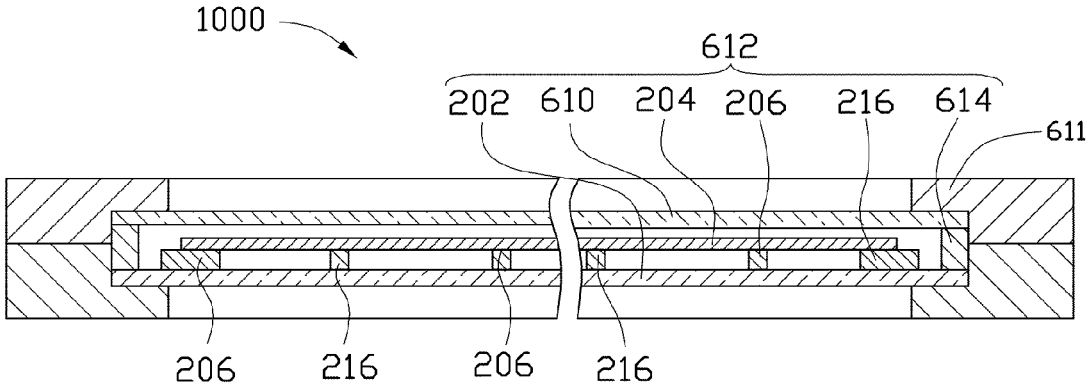
FIG. 39 is a cross-sectional view taken along a line 39-39 of the thermoacoustic module shown in FIG. 37.

Referring to FIGS. 38 and 39, the two fixing frames 611 can be symmetrically attached together and enclose the thermoacoustic module 612 therebetween. The thermoacoustic module 612 is interposed between the two engaging portions 6112 of the two fixing frames 611. The substrate 202 and the cover board 610 are attached the engaging portions 6112. Two lead wires are separately and electrically connected to the first conducting member 3210 and the second conducting member 3212 through the lead wire channels 61142.

Figure 40:
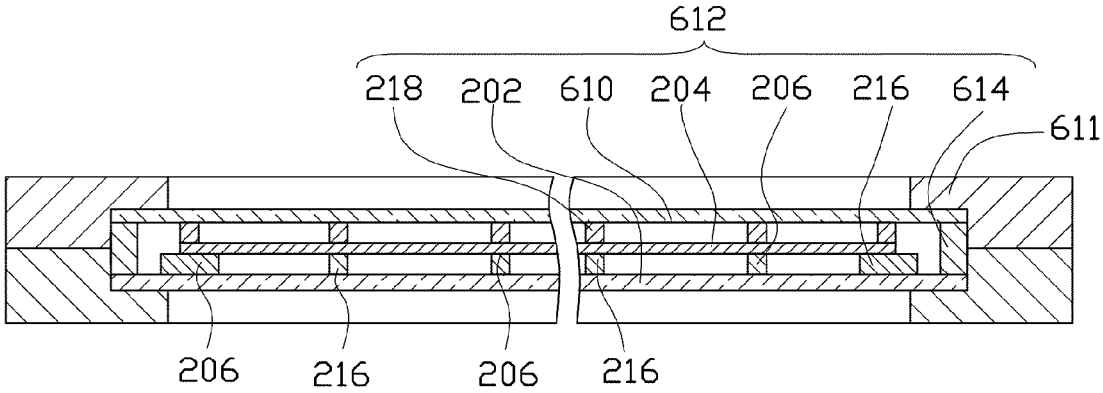
FIG. 40 is a cross-sectional view of one embodiment of a thermoacoustic device.

Referring to FIG. 40, in one embodiment, a plurality of spacers 218 can be arranged on the cover board 610 at a position being in alignment with the first or second electrodes 206, 216. More specifically, the spacers 218 are located above the first and second electrodes 206, 216, and sandwich the sound wave generator 204 therebetween.

More specifically, the spacer 218 can be integrated with the cover plate 610 or separated from the cover board 610. The spacer 218 can be fixed on the cover board 610. The shape of the spacer 218 is not limited and can be dot, lamellar, rod, wire, and block among other shapes. When the spacer 218 has a line shape such as a rod or a wire. A material of the spacer 218 can be conductive materials such as metals, conductive adhesives, and indium tin oxides among other materials. The material of the spacer 218 can also be insulating materials such as glass, ceramic, or resin among other materials. The spacers 218 can apply a pressure on the sound wave generator 204.

Figure 41:
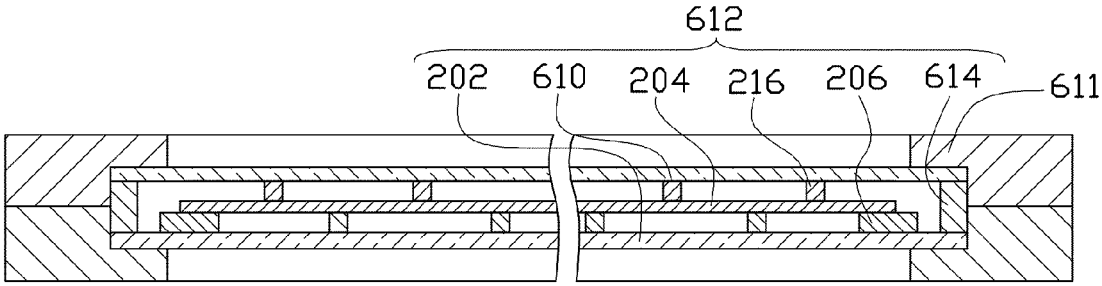
FIG. 41 is a cross-sectional view of one embodiment of a thermoacoustic device.

Referring to FIG. 41, in one embodiment, the location of the second electrodes 216 can be varied, they can be arranged on and mounted the cover board 610 but not on the substrate 202. The first electrodes 206 are located on the substrate 202.

The height of the supporters 614 can be equal to or smaller than the sum of the heights of the first electrode 206, the second electrode 216, and the sound wave generator 204.

Cover Board with Mesh

The cover board 610 can further have a mesh structure defining a plurality of openings therein. Therefore, the cover board 610 has a good sound and thermal transmittance. The cover board 610 is used to protect the sound wave generator 204 from being damaged or destroyed by outer forces. The openings can allow the exchange between the surrounding medium inside and outside of the cover board 610. The openings can be distributed in the cover board 610 orderly or randomly, entirely or partially. The cover board 610 can have a planar shape and/or a curved shape. A material of the cover board 610 can be conductive materials such as metals, or insulating materials such as plastics or resins. The openings of the cover board 610 can be formed by etching a metal plate or drilling a plastic or resin plate. The cover board 610 can also be a braiding or network weaved by metal, plastic, or resin wires. The size of the cover board 610 can be larger than the size of the sound wave generator 204 thereby covering the entire sound wave generator 204. In one embodiment, the size of the cover board 610 is equal to the size of the substrate 202.

Figure 42:
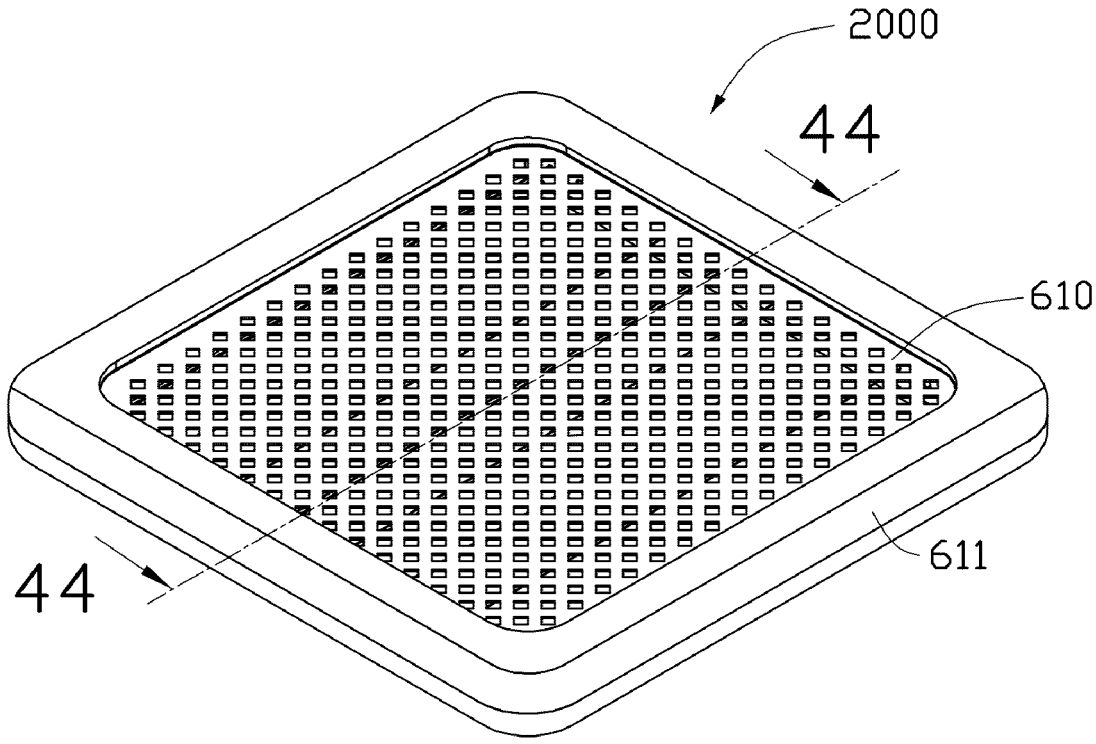
FIG. 42 is a schematic view of one embodiment of a thermoacoustic device.
Figure 43:
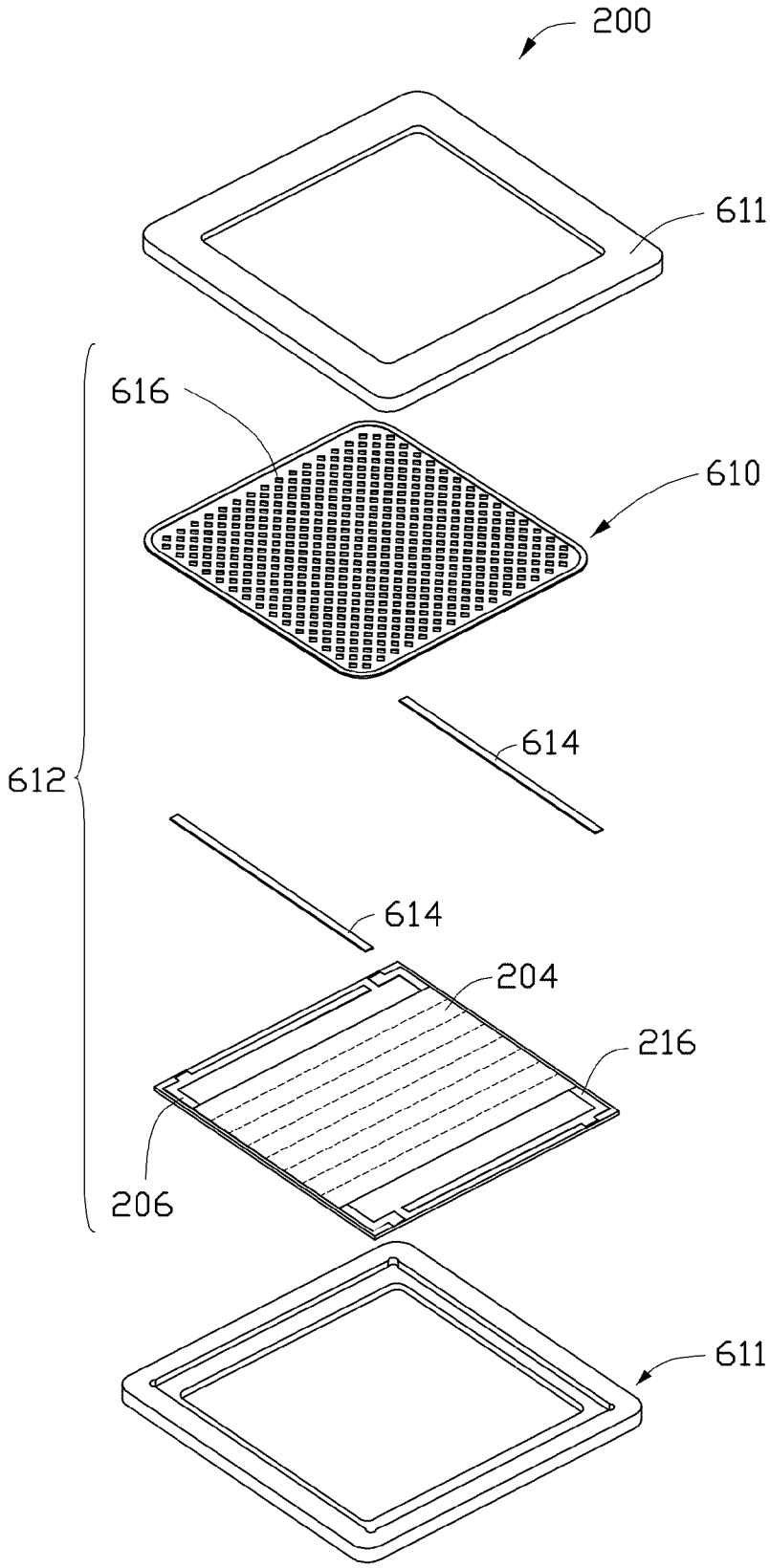
FIG. 43 is an exploded view of the thermoacoustic device shown in FIG. 42.
Figure 44:
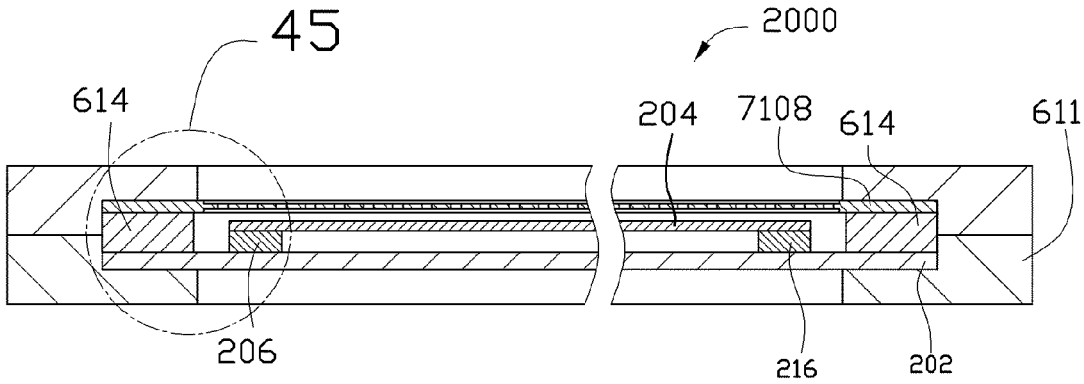
FIG. 44 is a cross-sectional view taken along a line 44-44 of the thermoacoustic device shown in FIG. 42.

Referring to FIGS. 42 to 44, a thermoacoustic device 2000 according to an embodiment includes a thermoacoustic module 612 and a frame 611. The thermoacoustic module 612 is fixed in the frame 611.

Referring to FIG. 43, the cover board 610 has a mesh structure defining a plurality of openings 616 therein. The substrate 202 has a top surface 230 (Shown in FIG. 44).

Figure 45:
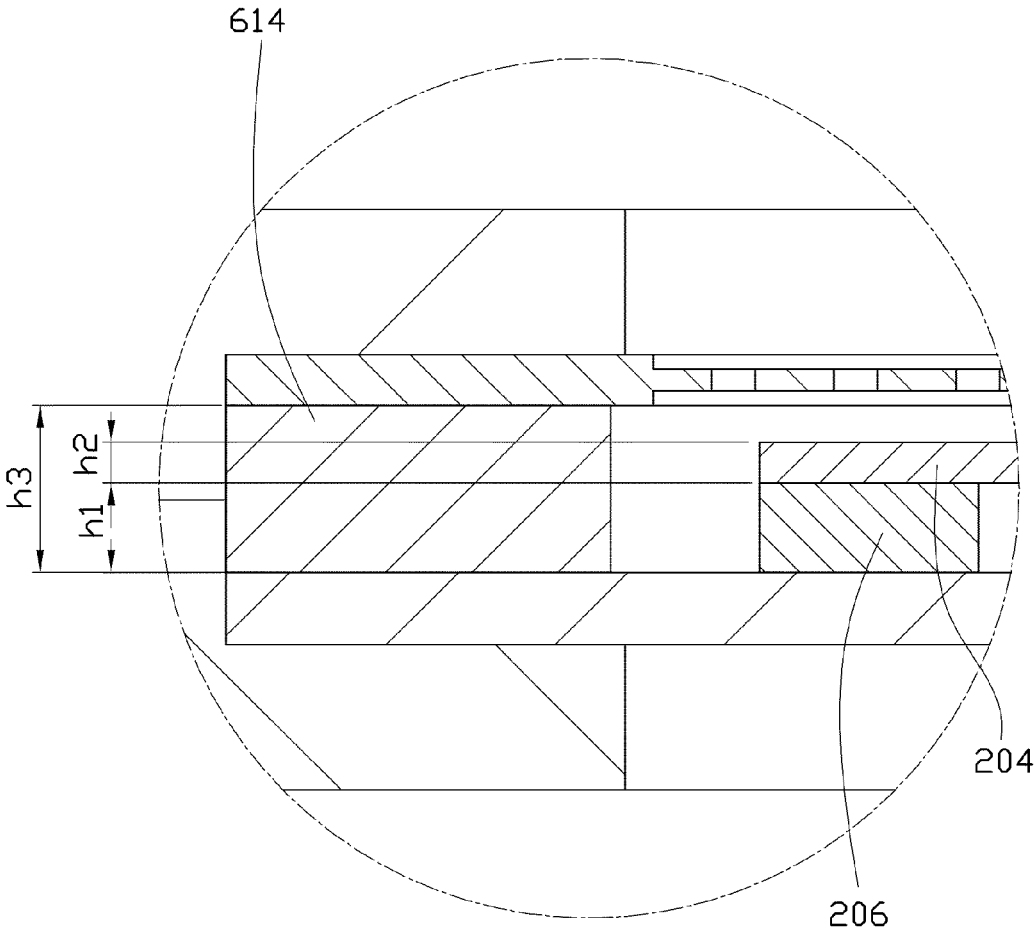
FIG. 45 is a partially enlarged view of section 45 of the thermoacoustic device shown in FIG. 44.

Referring to FIG. 45, the height h3 of the supporters 614 is greater than the height h1 of the first electrode 206 or the second electrode 216, together with the thickness h2 of the sound wave generator 204, thereby separating the sound wave generator 204 from the cover board 610.

In one embodiment, the cover board 610 is a planar stainless steel mesh, and the openings 616 are distributed in the cover board 610 uniformly and entirely.

Figure 46:
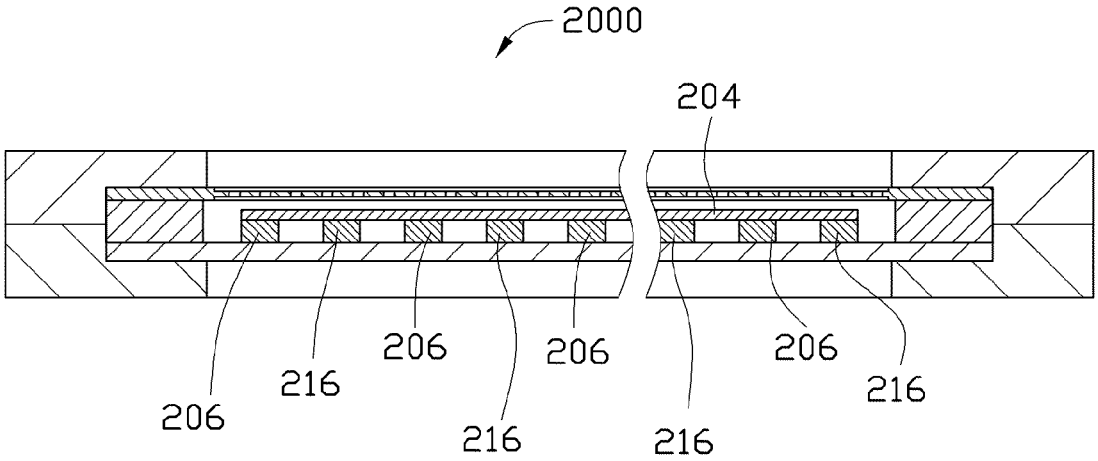
FIG. 46 is a cross-sectional view of one embodiment of a thermoacoustic device.

Referring to FIG. 42, the frame includes two fixing frames 611. The fixing frames 611 are disposed at the two sides of the thermoacoustic module 612. The two fixing frames 611 can cooperate with each other to fasten the thermoacoustic module 612 therebetween. The two fixing frames 611 can be fixed with each other by bolts, riveting, buckle, scarf, adhesive or any other connection means. It is easy to be understood that the thermoacoustic device 2000 can also includes a plurality of first electrodes 206, and a plurality of second electrodes 216. In the embodiment shown in FIG. 46, the thermoacoustic device 2000 includes four first electrodes 206 and four second electrodes 216. The first electrodes 206 and the second electrodes 216 can be arranged on the substrate 202 as a staggered manner of "+−+−".

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the invention. Variations may be made to the embodiments without departing from the spirit of the invention as claimed. Any elements discussed with any embodiment are envisioned to be able to be used with the other embodiments. The above-described embodiments illustrate the scope of the invention but do not restrict the scope of the invention.

What is claimed is:

1. A thermoacoustic module comprising:

a substrate;

at least one first electrode and at least one second electrode located on the substrate;

a sound wave generator spanning between and electrically connected to the at least one first electrode and the at least one second electrode, the sound wave generator having a bottom surface and a top surface, wherein the at least one first electrode and the at least one second electrode provide support to the sound wave generator; and at least one spacer located on the substrate to provide support to the sound wave generator such that an interval is defined between the sound wave generator and the substrate;

wherein the sound wave generator is capable of generating sound by converting electrical signal into heat, transferring the heat to the medium, and causing a thermoacoustic effect.

2. The thermoacoustic module of claim 1, wherein the at least one first electrode and the at least one second electrode are between the bottom surface of the sound wave generator and the substrate, and connected to the bottom surface of the sound wave generator.

3. The thermoacoustic module of claim 2, wherein the at least one spacer is located between the at least one first electrode and the at least one second electrode.

4. The thermoacoustic module of claim 1, wherein a shape of the at least one spacer is selected from the group consisting of dot, lamellar, rod, wire, block, and combinations thereof.

5. The thermoacoustic module of claim 1, wherein the at least one spacer comprises a plurality of spacers, and the plurality spacers are equidistance apart.

6. The thermoacoustic module of claim 1, wherein the at least one spacer is attached to the substrate via a binder or a screw.

7. The thermoacoustic module of claim 1, wherein the at least one spacer is integrated with the substrate.

8. The thermoacoustic module of claim 1, wherein the at least one spacer is conductive.

9. The thermoacoustic module of claim 1, wherein the sound wave generator is partially embedded in the at least one spacer.

10. The thermoacoustic module of claim 1, wherein the at least one first electrode comprises a plurality of first electrodes, the at least one second electrode comprises a plurality of second electrodes, and the plurality of first electrodes and the plurality of second electrodes are located on the substrate in a staggered manner.

11. The thermoacoustic module of claim 10, wherein the plurality of first electrodes and the plurality of second electrodes are parallel to each other, and adjacent first electrodes and second electrodes equidistant apart.

12. The thermoacoustic module of claim 1, wherein the sound wave generator comprises a carbon nanotube structure, the carbon nanotube structure comprises at least one carbon nanotube film, the at least one carbon nanotube film comprises a plurality of successive carbon nanotubes joined end-to-end by van der Waals attractive force therebetween, the plurality of successive carbon nanotubes in the at least one carbon nanotube film is substantially aligned along a single direction and substantially parallel to a surface of the at least one carbon nanotube film.

13. The thermoacoustic module of claim 1, wherein the sound wave generator comprises a plurality of carbon nanotubes substantially aligned along a direction from the at least one first electrode to the at least one second electrode.

14. A thermoacoustic module comprising:

a substrate;

at least one first electrode and at least one second electrode located on the substrate;

a carbon nanotube structure electrically connected to the at least one first electrode and the at least one second electrode; and a plurality of spacers located between the substrate and the carbon nanotube structure;

wherein the plurality of spacers space the carbon nanotube structure from the substrate, an interval is defined between the carbon nanotube structure and the substrate, the carbon nanotube structure comprises a plurality of carbon nanotubes substantially aligned along a direction from the at least one first electrode to the at least one second electrode;

wherein the sound wave generator is capable of generating sound by converting electrical signal into heat, transferring the heat to the medium, and causing a thermoacoustic effect.

15. The thermoacoustic module of claim 14, wherein the plurality of spacers is insulated from the at least one first electrode and the at least one second electrode.

16. The thermoacoustic module of claim 14, wherein the direction is substantially perpendicular to the at least one first electrode and the at least one second electrode.

17. The thermoacoustic module of claim 14, wherein the at least first electrode and at least second electrode are parallel to each other.

18. The thermoacoustic module of claim 17, wherein the plurality of spacers are linear shaped and parallel to each other.

19. The thermoacoustic module of claim 17, wherein the at least one first electrode and the at least one second electrode are located on a top surface of the carbon nanotube structure, and are positioned vertically above the spacers, each of the at least one first electrode and the at least one second electrode corresponds to one spacer.

20. A thermoacoustic device comprising:

a thermoacoustic module comprising:

a substrate;

at least one first electrode and at least one second electrode located on the substrate;

a sound wave generator spanning between and electrically connected to the at least one first electrode and the at least one second electrode, wherein the at least one first electrode and the at least one second electrode provide support to the sound wave generator; and at least one spacer located between the substrate and the sound wave generator;

and two fixing frames to secure the thermoacoustic module;

wherein the at least one spacer at least partially supports the sound wave generator, an interval is defined between the sound wave generator and the substrate, the sound wave generator comprises a plurality of carbon nanotubes substantially aligned along a direction from the at least one first electrode to the at least one second electrode;

wherein the sound wave generator is capable of generating sound by converting electrical signal into heat, transferring the heat to the medium, and causing a thermoacoustic effect.

* * * * *